US007963523B2

(12) United States Patent
Yoshimura et al.

(10) Patent No.: US 7,963,523 B2
(45) Date of Patent: Jun. 21, 2011

(54) SHEET STACKING APPARATUS, SHEET PROCESSING APPARATUS, AND IMAGE FORMING APPARATUS

(75) Inventors: Yuri Yoshimura, Mishima (JP); Masayoshi Fukatsu, Suntou-gun (JP); Atsushi Ogata, Mishima (JP); Junichi Sekiyama, Tokyo (JP); Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 147 days.

(21) Appl. No.: 12/326,662

(22) Filed: Dec. 2, 2008

(65) Prior Publication Data

US 2009/0146369 A1 Jun. 11, 2009

(30) Foreign Application Priority Data

Dec. 7, 2007 (JP) ..... 2007-316924
Feb. 14, 2008 (JP) ..... 2008-032545
Nov. 12, 2008 (JP) ..... 2008-289458

(51) Int. Cl.
*B65H 39/11* (2006.01)
*B65H 31/04* (2006.01)

(52) U.S. Cl. ..... 271/213; 271/214; 271/292; 271/207; 399/405

(58) Field of Classification Search ..... 271/207, 271/213, 214, 292–294; 399/405
See application file for complete search history.

(56) References Cited

U.S. PATENT DOCUMENTS

| | | | | |
|---|---|---|---|---|
| 4,880,223 | A * | 11/1989 | Yamazaki et al. | 271/293 |
| 5,056,774 | A * | 10/1991 | Kubota et al. | 271/213 |
| 5,104,106 | A * | 4/1992 | Shido et al. | 270/58.09 |
| 5,350,169 | A * | 9/1994 | Hiroi et al. | 271/213 |
| 5,722,030 | A * | 2/1998 | Kato | 399/403 |
| 6,352,253 | B1 | 3/2002 | Hayakawa et al. | |
| 6,357,736 | B1 * | 3/2002 | Kubota et al. | 270/58.08 |
| 6,722,646 | B2 | 4/2004 | Sekiyama et al. | |
| 6,735,415 | B2 | 5/2004 | Isobe et al. | |
| 6,843,476 | B2 * | 1/2005 | Schuller et al. | 271/207 |
| 6,942,206 | B2 | 9/2005 | Kuwata et al. | |
| 7,077,395 | B2 | 7/2006 | Ata et al. | |
| 2006/0239735 | A1 | 10/2006 | Ogata et al. | |
| 2007/0231036 | A1 | 10/2007 | Fukatsu et al. | |

FOREIGN PATENT DOCUMENTS

| | | |
|---|---|---|
| JP | 2003-95527 | 4/2003 |
| JP | 2006-256732 | 9/2006 |

* cited by examiner

*Primary Examiner* — Stefanos Karmis
*Assistant Examiner* — Luis A Gonzalez
(74) *Attorney, Agent, or Firm* — Fitzpatrick, Cella, Harper & Scinto

(57) ABSTRACT

The present invention provides a sheet stacking apparatus, whose lifting and lowering mechanism having excellent assembly properties and maintenance properties.
A sheet stacking apparatus includes: a stacking portion which stacks a discharged sheet thereon; a housing portion which can support the stacking portion so as to lift and lower the stacking portion; and a lifting and lowering mechanism which lifts and lowers the stacking portion. In the sheet stacking apparatus, the stacking portion has a connecting portion which connects the stacking portion to the housing portion. The connecting portion can connect the stacking portion to the housing portion in a direction perpendicular to the lifting and lowering direction of the stacking portion.

24 Claims, 17 Drawing Sheets

SHEET STACKING APPARATUS, SHEET PROCESSING APPARATUS, AND IMAGE FORMING APPARATUS

BACKGROUND OF THE INVENTION

1. Field of the Invention

The present invention relates to a sheet stacking apparatus on which a sheet received from an image forming apparatus body is stacked, a sheet processing apparatus, and an image forming apparatus. More specifically, the present invention relates to a sheet stacking apparatus which has a lifting and lowering mechanism of a sheet stack tray.

2. Description of Related Art

In recent years, the number of image forming apparatuses, such as a copying machine or a printer, which can be coupled to a sheet processing apparatus capable of selectively subjecting an image formed sheet to postprocessing such as stapling, has increased. These sheet processing apparatuses can lift and lower a sheet stack tray.

The tray is integrated with a driving member and is lifted and lowered by a pinion in the driving member and a rack provided in the apparatus. The tray is coupled to a belt and is lifted and lowered by a pulley (see Japanese Patent Application Laid-Open (JP-A) Nos. 2006-256732, and 2003-95527)

As described above, the lifting and lowering tray in the related art is of a rack & pinion type or a belt & pulley type for phase alignment of right and left rails as well as rails on both sides of a frame for supporting the load of the tray. The lifting and lowering tray need to be assembled and maintained while the installing posture of the apparatus in the used state is held. Since the operating procedure and the operating space are limited, there exist the following problems.

In the rack & pinion type described in JP-A No. 2006-256732, the tray which is integrated with the driving member is assembled to the rack extended in the lifting and lowering direction from above the apparatus in the used state. A space is required outside the lifting and lowering movement region (above or below the rack) during assembling.

Also in the belt & pinion type described in JP-A No. 2003-95527, the tray is guided by guide channels, extended in the lifting and lowering direction, which are formed in a front surface of a stacking wall from above the apparatus in the used state. The assembly properties and the maintenance properties are poor. Further, the member which couples the stack tray to the raising and lowering driving member is fixed to the belt. Phase alignment is necessary.

SUMMARY OF THE INVENTION

The present invention provides a lifting and lowering mechanism of a sheet stacking apparatus which is excellent in the assembly properties and the maintenance properties.

To achieve the above objects, a representative composition according to the present invention includes: a stacking portion on which a discharged sheet is stacked; a housing portion which can support the stacking portion so as to lift and lower the stacking portion; and a lifting and lowering mechanism which lifts and lowers the stacking portion. In the composition, the stacking portion has a connecting portion which connects the stacking portion to the housing portion, the connecting portion can connect the stacking portion to the housing portion in a direction crossing the lifting and lowering direction of the stacking portion.

The present invention has the above composition. The lifting and lowering mechanism of the sheet stacking apparatus of the present invention is connected detachably in the range of the sheet stacking and sheet takeout space in the used state. Other members around the lifting and lowering mechanism need not be detached. The lifting and lowering mechanism of the sheet stacking apparatus can be excellent in the assembly properties and the maintenance properties.

Further features of the present invention will become apparent from the following description of exemplary embodiments (with reference to the attached drawings).

DESCRIPTION OF THE EMBODIMENTS

Exemplary embodiments carrying out the present invention will be described below in detail with reference to the drawings. The dimensions, materials, shapes, and relative arrangement of components described in the embodiments should be changed appropriately according to the composition of an apparatus to which the present invention is applied and various conditions. The scope of the present invention is not limited to the following embodiments.

First Embodiment (Image Forming Apparatus)

The schematic composition of an image forming apparatus will be described.

Figure 1:
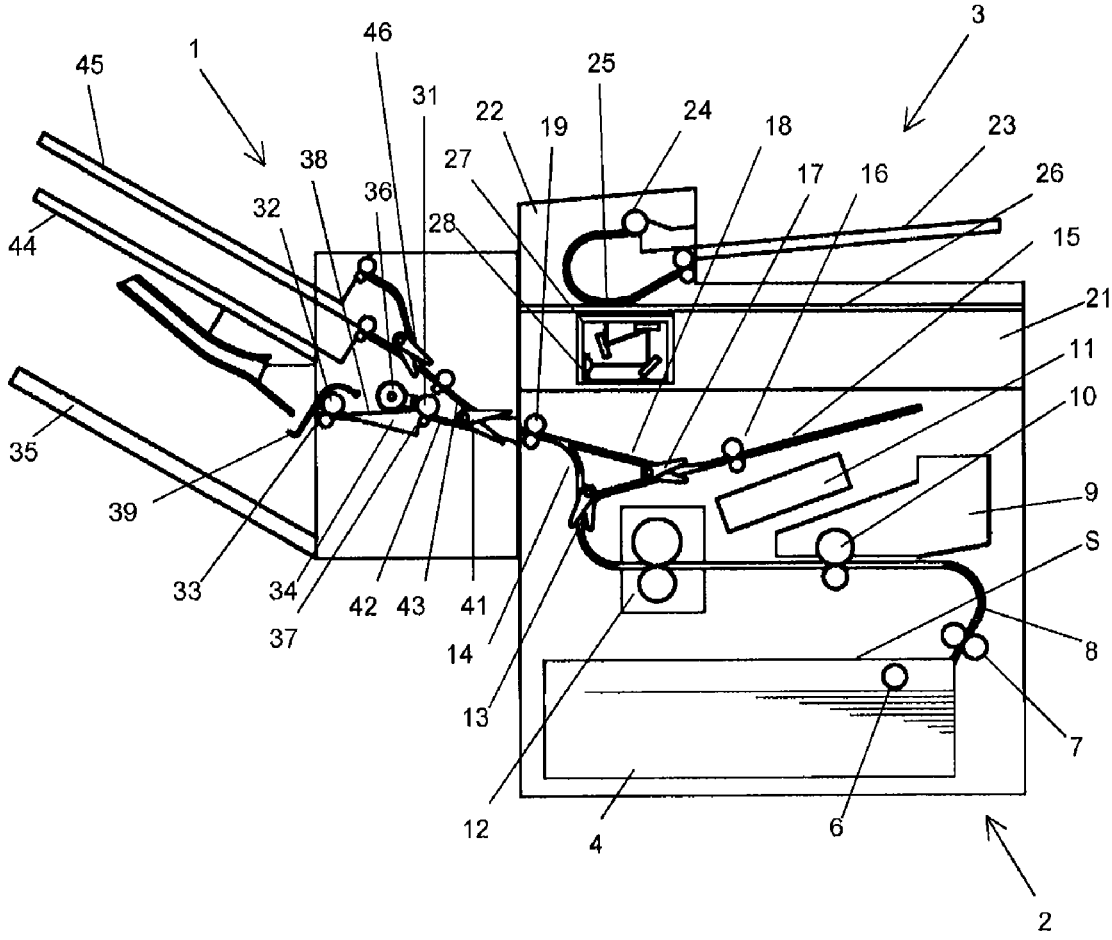
FIG. 1 is a schematic sectional view illustrating an image forming apparatus which is connected to a sheet processing apparatus according to a first embodiment.

FIG. 1 is a schematic sectional view illustrating the image forming apparatus which is connected to a sheet processing apparatus (sheet stacking apparatus) according to a first embodiment.

As illustrated in FIG. 1, a sheet processing apparatus 1 as the sheet stacking apparatus according to the first embodiment is connected to an image forming apparatus body, and selectively subjects an image formed sheet to a predetermined process such as stapling. Here, a stapler (binding portion) is illustrated as a portion which performs the sheet process. The present invention is not limited to this. The portion which performs the sheet process may be other processing portions, such as a punching portion or a folding portion. These processing portions may be used in combination as appropriate. The image forming apparatus has an image forming apparatus body 2 which forms an image on a sheet, and an image reading portion 3 which is connected to the image forming apparatus body 2 and reads the described information of an original.

As illustrated in FIG. 1, in the image forming apparatus body 2, a plurality of sheets S stacked on a sheet cassette 4 are separated and fed one by one by a feeding roller 6 and a separating and conveying roller 7. Each of the sheets S is conveyed to an image forming process unit 9 by a conveying guide 8.

The image forming process unit 9 which composes an image forming portion forms an image (toner image) by an electrophotographic system. Specifically, a photosensitive drum 10 as an image bearing member provided in the image forming process unit 9 is charged. A laser scanner 11 irradiates the photosensitive drum 10 with light to form an image. The image is developed using toner. The developed toner image is transferred onto the sheet S.

The sheet S on to which the toner image is transferred from the photosensitive drum 10 is conveyed to a fixing device 12. The image is then fixed to the sheet S by applying heat and pressure.

The image fixed sheet S is conveyed by a conveying path switching member 13 to either of a face-up conveying path 14 and a switchback conveying path 15 which reverses the leading and trailing ends of the sheet.

The sheet which has been conveyed to the switchback conveying path 15 is conveyed by a switchback conveying roller 16 until the trailing end of the sheet passes through a reverse switching member 17. The sheet is reversed and conveyed by the switchback conveying roller 16 such that its trailing end in turn becomes its leading end. The reversed sheet is switched by the reverse switching member 17 and is then conveyed to a face-down conveying path 18.

The face-up conveying path 14 and the face-down conveying path 18 are joined just before a discharge roller 19. Both the sheet guided to the face-up conveying path 14 and the sheet guided from the switchback conveying path 15 to the face-down conveying path 18 are discharged from the image forming apparatus body 2 by the discharge roller 19.

As illustrated in FIG. 1, the image reading portion 3 has a scanner portion 21, and an auto document feeder (hereinafter called an ADF) 22. The ADF 22 can be opened or closed about a hinge, not illustrated, on the rear side of the apparatus. When the original is manually set on an original base plate glass 26, the ADF 22 is opened upward relative to the original base plate glass 26.

The scanner portion 21 has a movable optical carriage 27 and reads the described information of the original. In the scanner portion 21, the described information of the original set on the original base plate glass 26 is scanned horizontally and read by the optical carriage 27, and is then photoelectrically converted by a CCD 28.

The ADF 22 separates and feeds a plurality of originals stacked on an original stack tray 23 one by one by a feeding roller 24. The ADF 22 then passes each of the originals through an original reading position 25 of the optical carriage 27 stopped in the scanner portion 21. During the passing, the optical carriage 27 reads the described information of the original which is being conveyed.

(Sheet Processing Apparatus)

Figure 2:
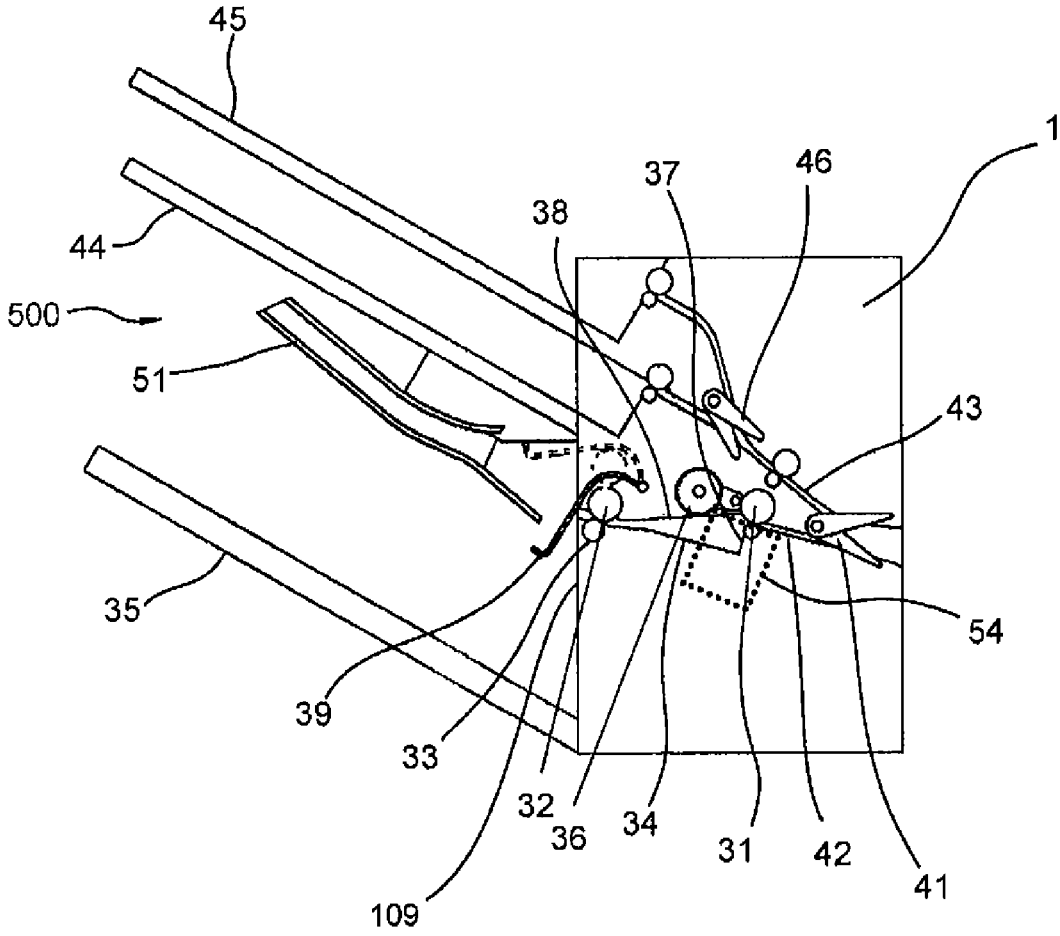
FIG. 2 is a schematic sectional view describing the composition of the sheet processing apparatus 1 according to the first embodiment.

The sheet processing apparatus 1 (the sheet stacking apparatus) of this embodiment will be described with reference to FIG. 2. FIG. 2 is a schematic sectional view describing the composition of the sheet processing apparatus 1 according to the first embodiment.

Figure 3A:
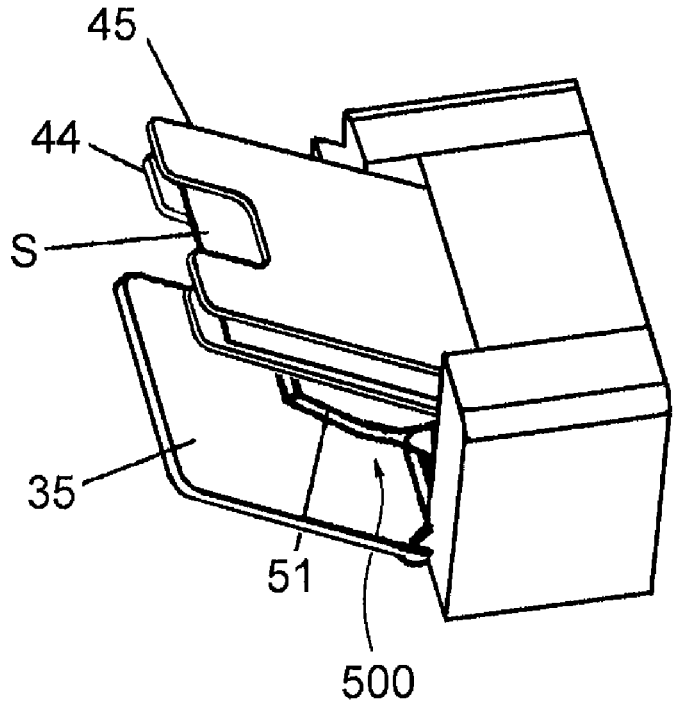
FIGS. 3A and 3B are external views of the sheet processing apparatus 1 according to the first embodiment.

A position where the user faces an operation displaying device (not illustrated) to perform various inputs/settings to the image forming apparatus body 2 is called the front side of the image forming apparatus, and the rear side of the apparatus is called the rear side. FIG. 3A illustrates the composition of the image forming apparatus seen from the front side of the apparatus. The sheet processing apparatus 1 is connected to the side of the image forming apparatus body 2, and receives and staples the sheet discharged by the discharge roller 19 of the image forming apparatus body 2.

In FIG. 2, an intermediate conveying roller 31 is disposed in the sheet processing apparatus 1. The sheet stapled or not stapled by the stapler described below is discharged by an upper discharge roller 32 and a lower discharge roller 33 (discharge portion). The sheet discharged as such is stacked on a first stack tray 35.

When the stapling process is selected, the sheet received from the image forming apparatus body 2 is temporarily stacked on an intermediate stacking portion 34. A conveying guide 38 is provided in the upper portion of the intermediate stacking portion 34.

The sheet stacked on the intermediate stacking portion 34 is aligned by an aligning roller 36 in the sheet conveying direction. The aligning roller 36 can be moved up and down relative to the stacking surface of the intermediate stacking portion 34. The lowered aligning roller 36 is abutted onto the surface of the sheet on the intermediate stacking portion 34. The lowered aligning roller 36 is then moved so as to abut the trailing end of the sheet onto an aligning reference wall 37 for alignment. The lifted aligning roller 36 is retracted to a position which is not troublesome when the sheet is conveyed into the intermediate stacking portion 34.

The sheet stacked on the intermediate stacking portion 34 is aligned in the sheet width direction by an aligning member 500. The aligned sheet is stapled by a stapler 54 (sheet processing portion) located on the front side of the apparatus.

As illustrated in FIG. 2, the sheet processing apparatus 1 has a stacking wall 109 onto which the trailing end of the sheet stacked on the first stack tray 35 is abutted.

A stacking height detection flag 39 is provided on the downstream side of the upper discharge roller 32 and the lower discharge roller 33. The stacking height detection flag 39 detects that the topmost sheet surface height of the sheets stacked on the first stack tray 35 has reached a predetermined height. A central processing unit (CPU), not illustrated, judges that the sheets are stacked at full height based on a detecting signal indicating that the top most sheet surface height has reached the predetermined height. The upper discharge roller 32 can be retracted from the lower discharge roller 33 to a position indicated by the dashed line in FIG. 2. The stacking height detection flag 39 is pushed up by the upper discharge roller 32 so as to be moved to a position indicated by the dashed line.

In addition to the first stack tray 35 described above, the sheet processing apparatus 1 has at least a second stacking portion on which the received sheet is stacked. In FIG. 2, the sheet processing apparatus 1 has, as the second stacking portion, stack trays 44 and 45 which stack thereon the sheet divided among them. The stack trays 44 and 45 are provided above the aligning member 500. A switching member 41 switches between the directions of the sheet to convey the sheet to a staple conveying path 42 or a dividing conveying path 43. The sheet conveyed to the dividing conveying path 43 is divided among the conveying paths by a dividing switching member 46. The sheet is then discharged to the stack tray 44 or the stack tray 45 as the second stacking portion by the respective discharge rollers.

Figure 3B:
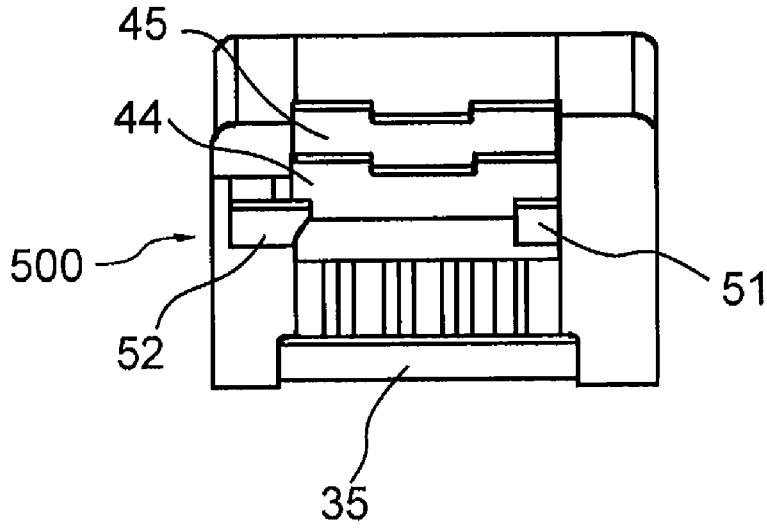
Figure 4:
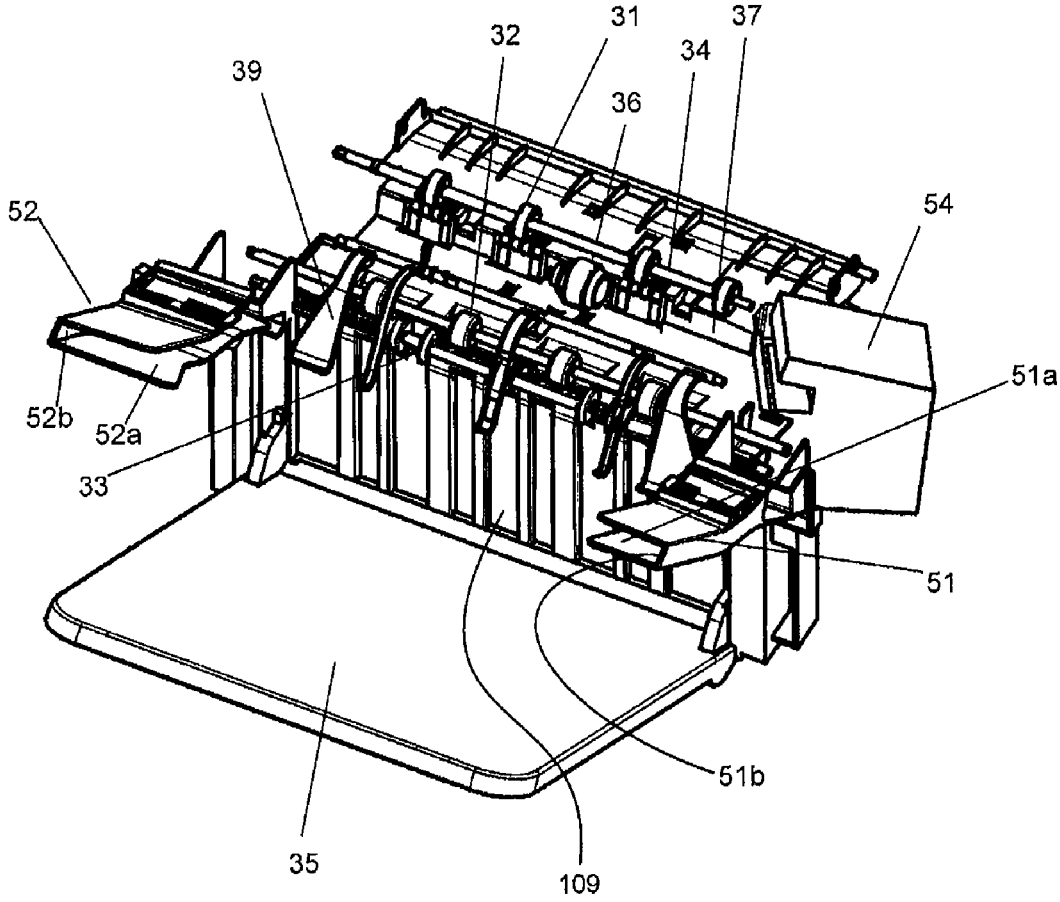
FIG. 4 is a perspective view of an intermediate stacking portion 34 according to the first embodiment seen in the sheet conveying direction.

Referring now to FIGS. 3A, 3B, and 4, the aligning member 500 which performs aligning in the sheet width direction when the stapling process is selected will be described. FIGS. 3A and 3B are external views of the sheet processing apparatus 1 according to the first embodiment. FIG. 4 is a perspective view of the intermediate stacking portion 34 according to the first embodiment seen in the sheet conveying direction.

As illustrated in FIGS. 3A, 3B, and 4, the aligning member 500 has a reference side jogger 51 and an aligning side jogger 52 which are provided above the stacking wall 109. The joggers 51 and 52 have sheet holding surfaces 51*a* and 52*a* which can hold the lower surface of the sheet together with the intermediate stacking portion 34 and sheet aligning surfaces 51*b* and 52*b* which can be abutted onto the end of the sheet in the width direction. The joggers 51 and 52 can be moved in the sheet width (front/rear) direction. Alignment in the sheet width direction is performed by the movement of the joggers 51 and 52.

(Tray Lifting and Lowering Mechanism)

Figure 5:
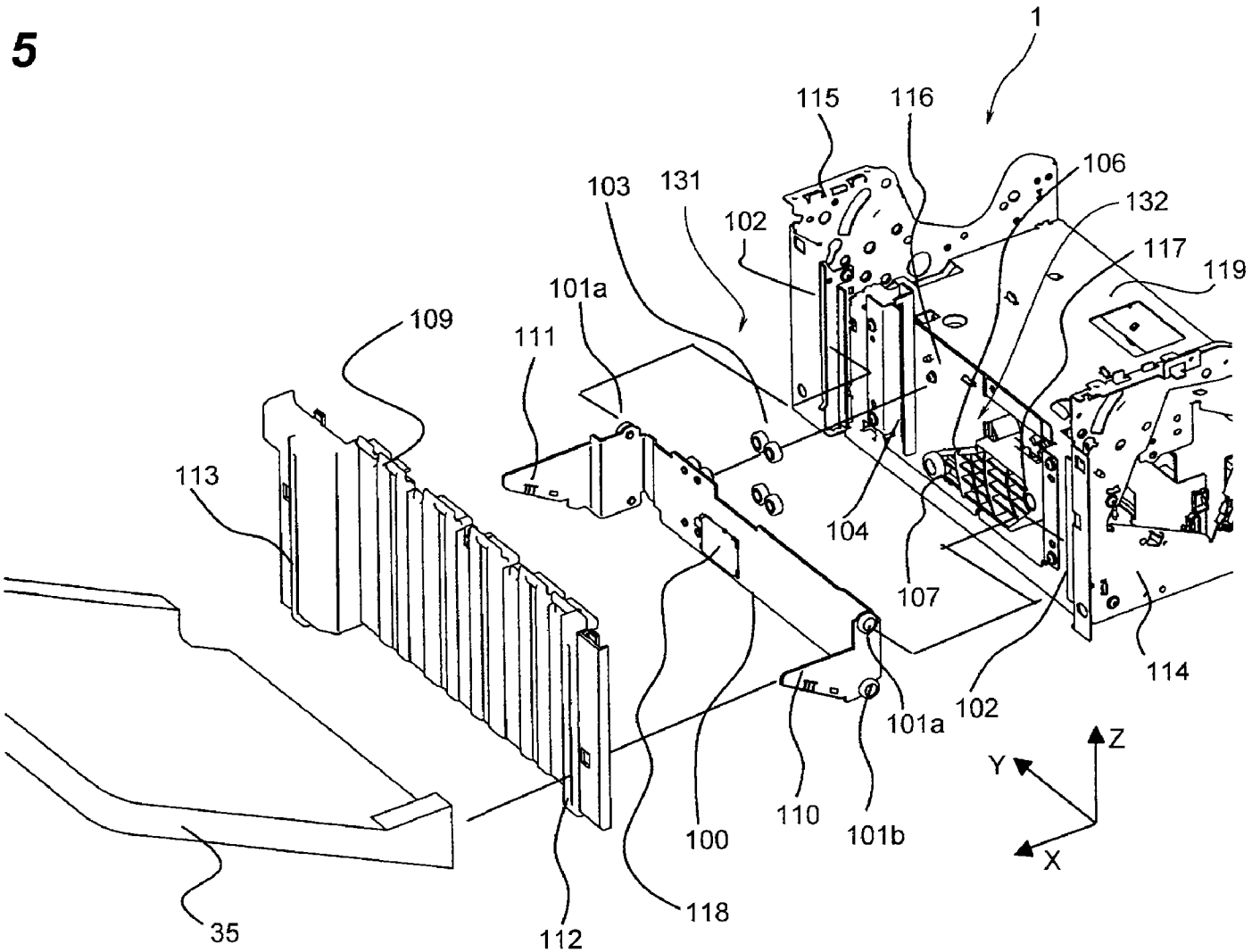
FIG. 5 is an exploded perspective view of a stacking portion and a tray lifting and lowering mechanism according to the first embodiment.

The tray lifting and lowering mechanism (lifting and lowering mechanism) will be described. FIG. 5 is an exploded perspective view of the stacking portion and the tray lifting and lowering mechanism according to the first embodiment. In FIG. 5, the sheet conveying direction is indicated by X, the sheet width direction is indicated by Y, and the vertical direction is indicated by Z.

As illustrated in FIG. 5, the first stack tray 35 is installed in a tray coupling member (coupling member) 100 through elongated slots 112 and 113 of the stacking wall 109. An XZ load supporting roller 101 (101*a* and 101*b*) which composes a connecting portion is a member which connects the first stack tray 35 to an XZ load supporting rail 102 so as to lift and lower the first stack tray 35.

The tray coupling member 100 is installed in a housing portion (a housing front frame 114, a housing rear frame 115, and a housing center frame 119). The XZ load supporting rail (rail member) 102 as a guide member is provided in the housing front frame 114 or the housing rear frame 115 of the housing portion so as to be extended along the lifting and lowering direction. The XZ load supporting rail 102 has opposing guide surfaces in the YZ plane.

As illustrated in FIG. 5, the housing portion can support a YZ load supporting rail 104, a tray lifting and lowering lever 106, a lifting and lowering roller 107, a base 116, and a fulcrum shaft 117, as lifting and lowering driving members. A sensor light-shielding portion 140, an upper limit detecting sensor 141, and a lower limit detecting sensor 142, which compose the lifting and lowering mechanism together with the lifting and lowering driving members are assembled to the housing portion. Gears 144 to 149 (see FIG. 1A), a motor 150 (see FIG. 1A), a lifting and lowering driving box 160 (see FIGS. 10B and 12A) are assembled to the housing portion. The respective members will be described in detail below.

The tray coupling member 100 is installed on the opposite side of the first stack tray 35 so as to interpose the stacking wall 109 therebetween. A front arm portion 110 and a rear arm portion 111 of the tray coupling member 100 pass through the elongated holes 112 and 113 on the front and rear sides of the apparatus of the stacking wall 109 to protrude from the face portion of the stacking wall 109. The front arm portion 110 and the rear arm portion 111 are then connected to the first stack tray 35. A stacking portion (the first stack tray 35, the stacking wall 109, and the tray coupling member 100) is thus composed.

The upper XZ load supporting roller 101*a* and the lower XZ load supporting roller 101*b* guided by the XZ load supporting rail 102 are held onto the front arm portion 110 of the tray coupling member 100. The upper XZ load supporting roller 101*a* and the lower XZ load supporting roller 101*b* guided by the XZ load supporting rail 102 are held onto the rear arm portion 111 of the tray coupling member 100.

The XZ load supporting rail 102 is fixed to the housing front frame 114 or the housing rear frame 115. The lower portion of the XZ load supporting rail 102 is closed by a portion of the housing front frame 114 or the housing rear frame 115. The XZ load supporting rail 102 is U-shaped. In the assembled state, the XZ load supporting rail 102 is engaged with the XZ load supporting roller 101 to suppress the rattling of the tray coupling member 100 in the XZ direction, thereby receiving the load. The housing center frame 119 is disposed between the housing front frame 114 and the housing rear frame 115.

Two YZ load supporting rollers 103 as a restricting portion are axially supported on the upper side of the back side of the tray coupling member 100. Two YZ load supporting rollers 103 as the restricting portion are axially supported on the lower side of the back side of the tray coupling member 100.

The YZ load supporting rail 104 which composes the restricting portion together with the YZ load supporting roller 103 is fixed to the base 116. In the assembled state, the YZ load supporting rollers 103 interpose the YZ load supporting rail 104 therebetween to suppress the rattling of the tray coupling member 100 in the YZ direction, thereby receiving the load.

The rotatable tray lifting and lowering lever 106 is axially rotatably supported by the fulcrum shaft 117 of the base 116. The lifting and lowering roller 107 is axially rotatably supported at the top end of the tray lifting and lowering lever 106.

A rectangular hole portion 118 is provided in the substantially center of the tray coupling member 100. In the assembled state, at first the lifting and lowering roller 107 stands by in a lower limit position of a rotating range. When the tray coupling member 100 is in an inclined state on the way to assemble, the lifting and lowering roller 107 is fitted into the hole portion 118 and the upper side of the hole portion 118 is lifted by the lifting and lowering roller 107 by an upward rotation of the lifting and lowering roller 107. The tray coupling member 100 is lifted and lowered.

Figure 6A:
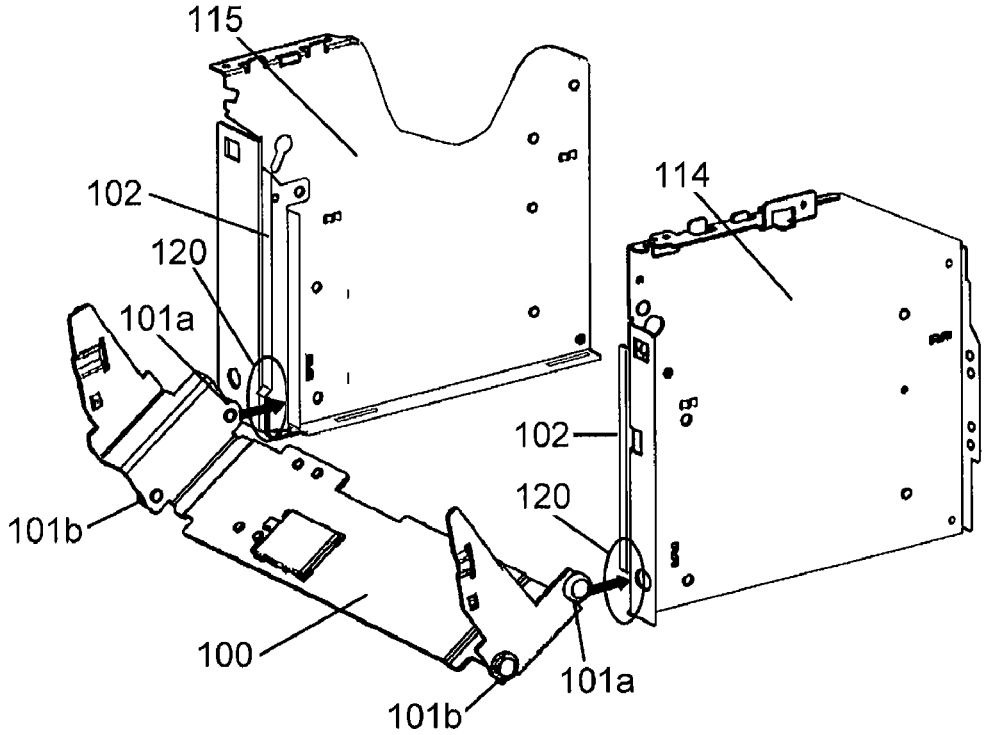
FIGS. 6A and 6B are perspective views illustrating the state of assembling an XZ load supporting roller 101 to housing frames 114 and 115 according to the first embodiment.
Figure 6B:
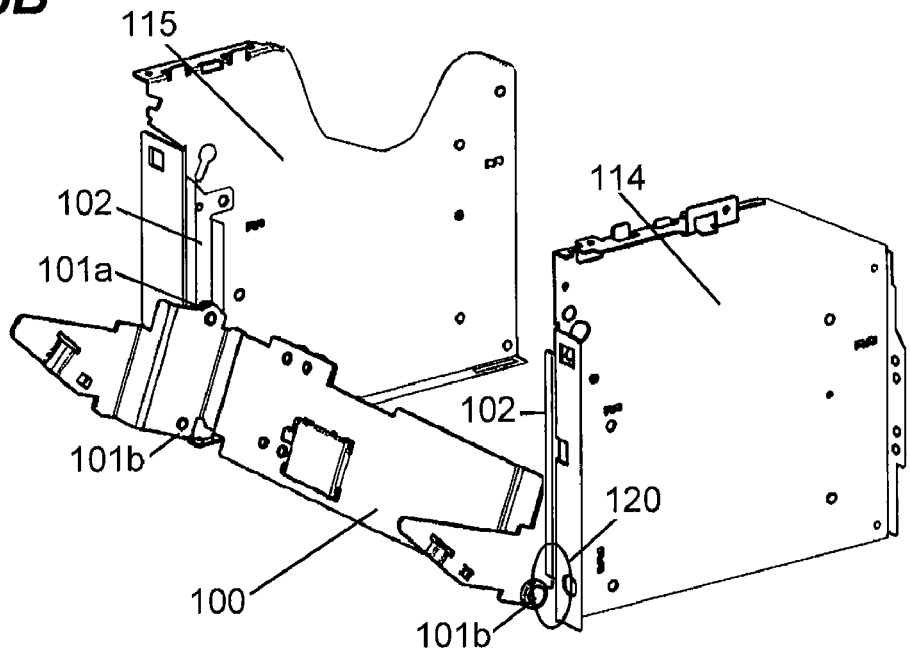

FIGS. 6A and 6B are perspective views illustrating the state of assembling the XZ load supporting roller 101 to the housing frames 114 and 115 according to the first embodiment. In FIGS. 6A and 6B, the four XZ load supporting rollers 101 provided in the tray coupling member 100 are engaged with the XZ load supporting rails 102, and the tray coupling member 100 is then assembled to the housing frames 114 and 115.

A notch 120 is provided at the lower end of the XZ load supporting rail 102. The notch 120 is opened to the downstream side in the sheet discharge direction perpendicular to the lifting and lowering direction of the first stack tray 35. The notch 120 is of the size through which one of the XZ load supporting rollers 101 can pass, and is smaller than the pitch between the upper XZ load supporting roller 101*a* and the lower XZ load supporting roller 101*b*. When the lower portion of the rail is closed, the stacking portion can be detachably fitted into the notch 120 on the downstream side in the sheet discharge direction crossing the lifting and lowering direction of the stacking portion. The stacking portion and the lifting and lowering mechanism can be assembled in a direction crossing the lifting and lowering direction of the first stack tray 35 without changing the installing posture of the housing. The workability can be improved. Here, the installing posture of the housing coincides with the installing posture of the apparatus in the used state. The installing posture of the housing during assembling coincides with the installing posture of the apparatus in the used state. As in assembling, during maintenance, the stacking portion and the lifting and lowering mechanism can be assembled in a direction crossing the lifting and lowering direction of the first stack tray 35 without changing the installing posture of the apparatus in the used state.

In this embodiment, the notch 120 is opened to the downstream side in the sheet discharge direction. The present invention is not limited to this. When the stacking portion and the lifting and lowering mechanism are connected detachably during assembling and maintenance without changing the installing posture of the housing, the notch 120 may be opened in other directions such as a direction perpendicular to the sheet discharge direction.

As illustrated in FIG. 6A, the upper XZ load supporting roller 101*a* of the tray coupling member 100 is inserted from the notch 120 into the XZ load supporting rail 102.

As illustrated in FIG. 6B, the tray coupling member 100 is moved upward to a position where the lower XZ load supporting roller 101*b* can pass through the notch 120. The lower XZ load supporting roller 101*b* is inserted from the notch 120 into the XZ load supporting rail 102. The tray coupling member 100 is assembled to the housing frames 114 and 115.

Figure 7A:
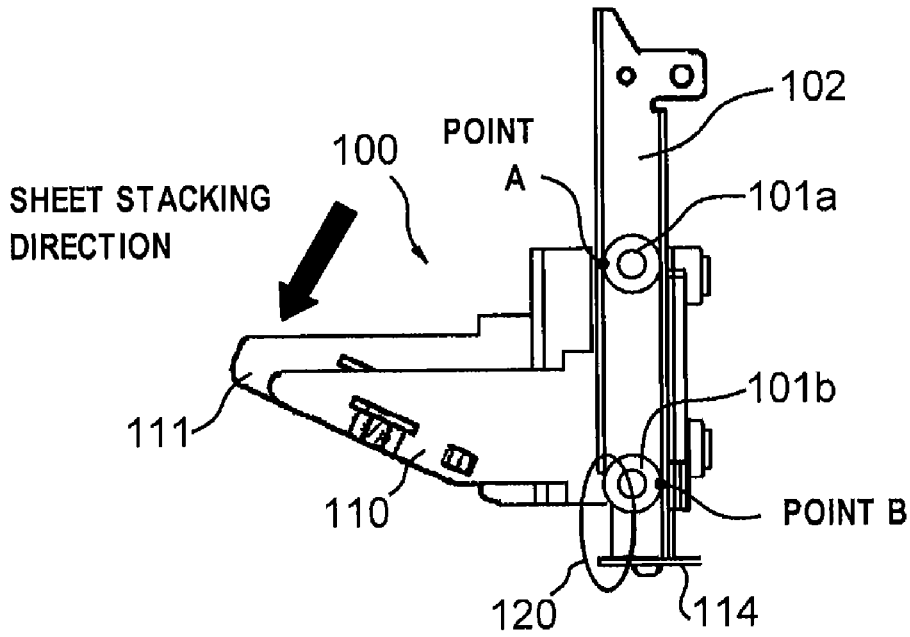
FIGS. 7A and 7B are diagrams describing the XZ load supporting roller 101 and an XZ load supporting rail 102 of a tray coupling member 100 in the assembled state according to the first embodiment.
Figure 7B:
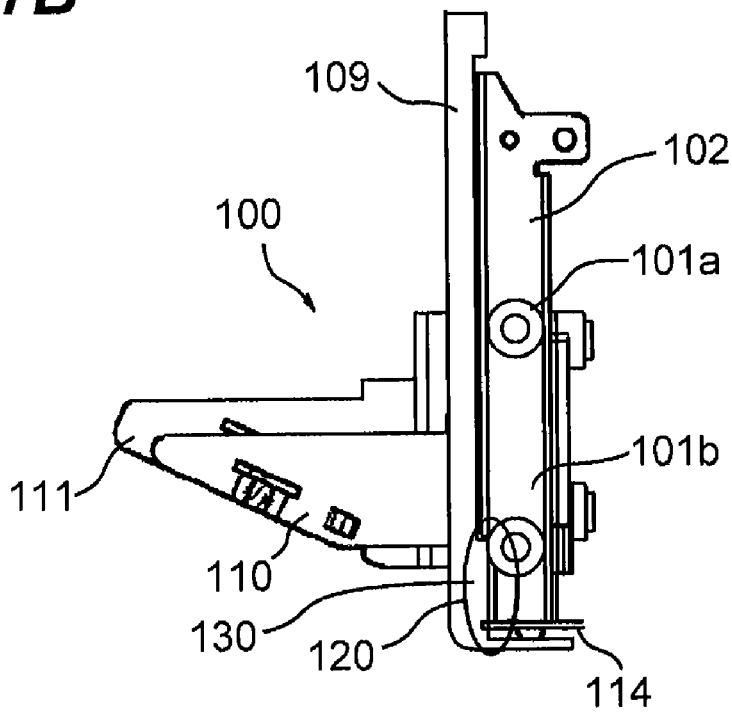

FIGS. 7A and 7B are diagrams describing the XZ load supporting roller 101 and the XZ load supporting rail 102 of the tray coupling member 100 in the assembled state according to the first embodiment.

In FIG. 7A, the first stack tray 35, not illustrated, is located on the left side. The first stack tray 35 and the weight of the sheet stacked on the first stack tray 35 are supported at a point A in which the upper XZ load supporting roller 101*a* and the XZ load supporting rail 102 are contacted and a point B in which the lower XZ load supporting roller 101*b* and the XZ load supporting rail 102 are contacted. The notch 120 is located in the lower portion of the XZ load supporting rail 102, and is smaller than the pitch between the upper XZ load supporting roller 101*a* and the lower XZ load supporting roller 101*b*. This cannot affect the supporting of the load.

FIG. 7B is a cross-sectional view in which the stacking wall 109 is added to FIG. 7A. A notch closing portion 130 is provided integrally with the back side of the stacking wall 109. As described above, the tray coupling member 100 is assembled to the housing front frame 114 and the housing rear frame 115, and the stacking wall 109 is then assembled to the housing front frame 114 and the housing rear frame 115. The notch closing portion 130 has a shape closing the notch 120. The notch 120 is closed to prevent the XZ load supporting roller 101 from passing through the notch 120 in the reverse direction to assembling.

When the top end of the first stack tray 35 is lifted by the user to apply a force which rotates the first stack tray 35 about the stacking wall 109, falling of the tray coupling member 100 out of the XZ load supporting rail 102 can be prevented.

Figure 8:
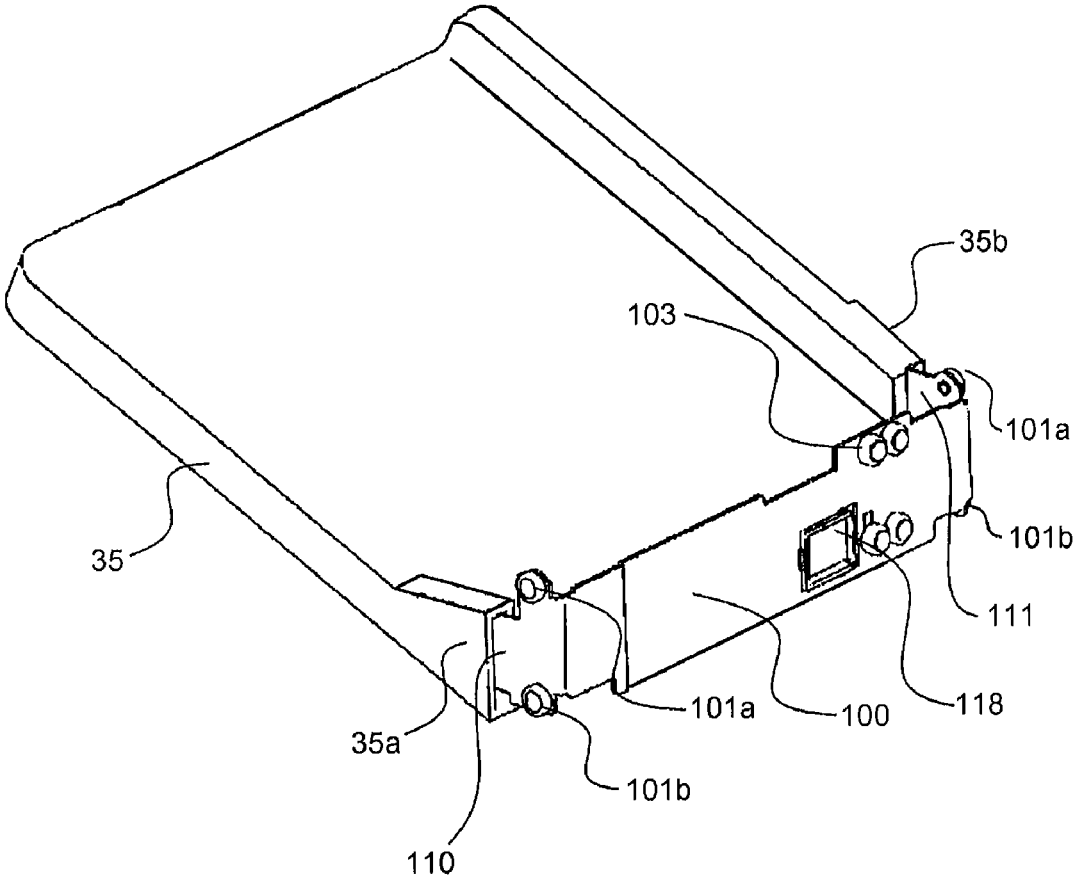
FIG. 8 is a perspective view illustrating the state of integrating a first stack tray 35 with the tray coupling member 100 according to the first embodiment.

FIG. 8 is a perspective view illustrating the state of integrating the first stack tray 35 with the tray coupling member 100 according to the first embodiment. In FIG. 8, they are seen from the conveying upstream side.

As illustrated in FIG. 8, there are holes 35*a* and 35*b* in the first stack tray 35 on the front and rear sides of the apparatus. The front arm portion 110 and the rear arm portion 111 of the tray coupling member 100 are inserted and fitted into the holes 35*a* and 35*b*.

Figure 9:
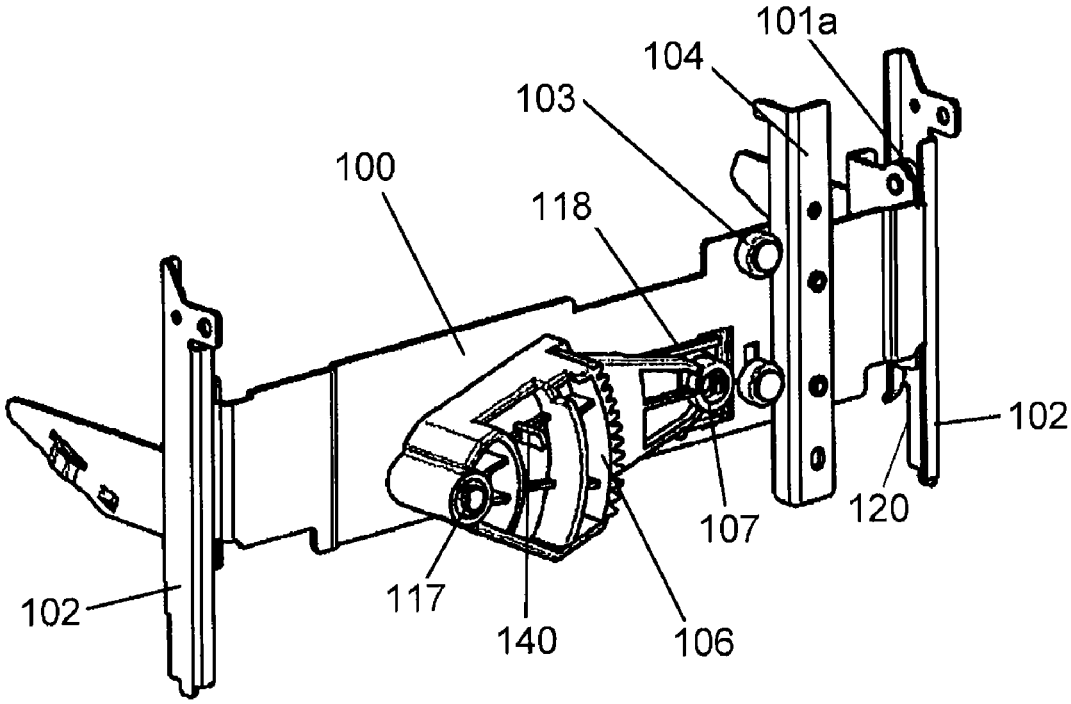
FIG. 9 is a perspective view illustrating the state of adding a tray lifting and lowering lever 106 to the tray coupling member 100 according to the first embodiment.

FIG. 9 is a perspective view illustrating the state of adding the tray lifting and lowering lever 106 to the tray coupling member 100 according to the first embodiment.

As illustrated in FIG. 9, the tray lifting and lowering lever 106, the XZ load supporting rail 102, the XZ load supporting roller 101, the YZ load supporting rail 104, and the YZ load supporting roller 103 are disposed in the tray coupling member 100. The sensor light-shielding portion 140 is disposed integrally with the tray lifting and lowering lever 106.

Figure 10A:
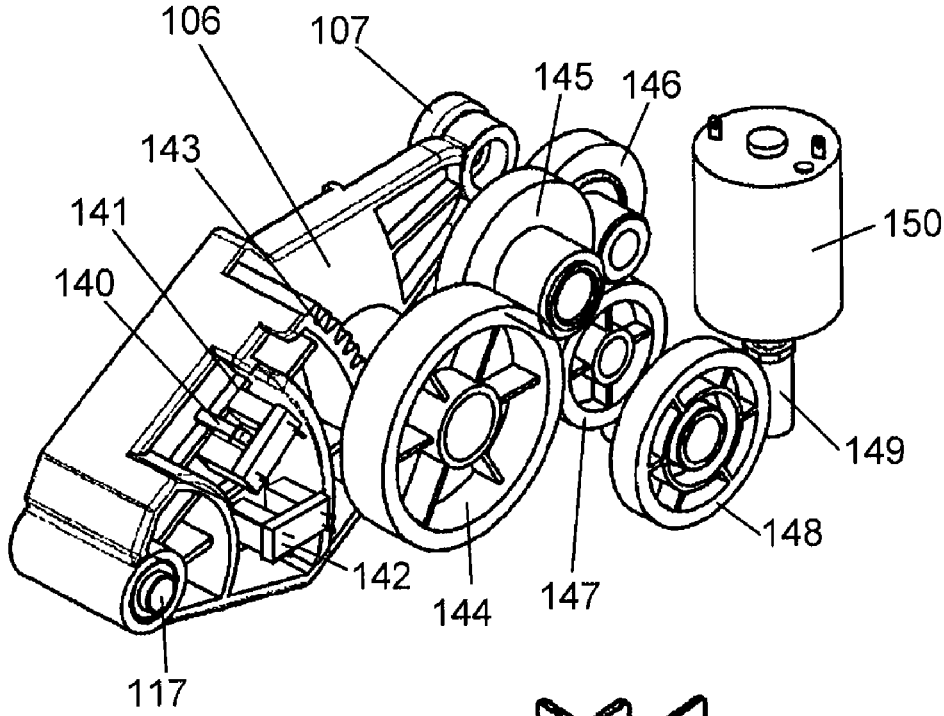
FIGS. 10A and 10B are diagrams describing the tray lifting and lowering lever 106 and a driving portion according to the first embodiment.
Figure 10B:
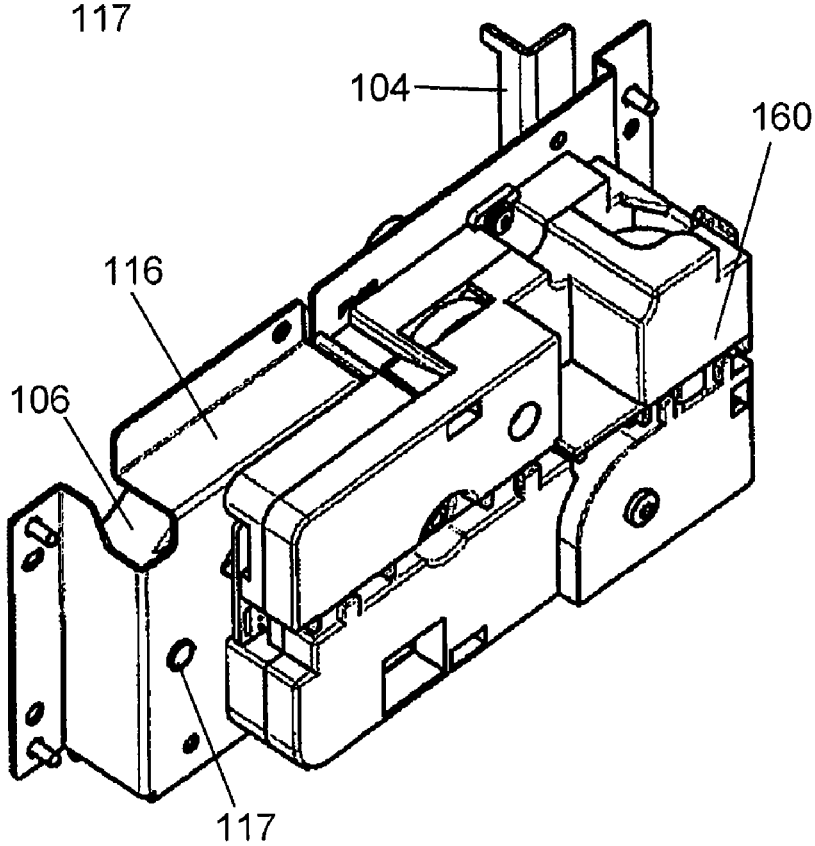

FIGS. 10A and 10B are diagrams describing the tray lifting and lowering lever 106 and the driving portion according to the first embodiment. The driving portion is on the upstream side in the sheet conveying direction of the tray lifting and lowering lever 106.

Figure 11A:
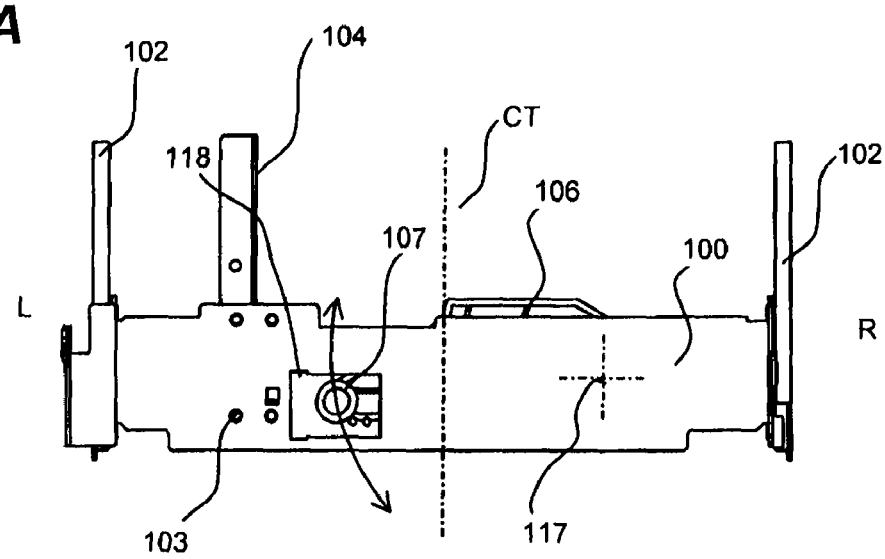
FIGS. 11A, 11B, and 11C are diagrams of the tray lifting and lowering mechanism according to the first embodiment seen from the tray.

As illustrated in FIG. 11A, the upper limit detecting sensor 141 and the lower limit detecting sensor 142 of the tray lifting and lowering lever 106 are disposed in the tray lifting and lowering lever 106.

When the tray lifting and lowering lever 106 is rotated, the sensor light-shielding portion 140 light shields the upper limit detecting sensor 141 and the lower limit detecting sensor 142 to control rotation.

A gear 143 provided on the tray lifting and lowering lever 106 and the gears 144, 145, 146, 147, 148, and 149 sequentially coupled thereto are disposed on the tray lifting and lowering lever 106. The motor 150 is also disposed. The tray lifting and lowering lever 106 is rotated by these driving members, the upper and lower limit detecting sensor information, and the central processing unit (CPU), not illustrated.

As illustrated in FIG. 10B, the driving members (the gears 144 to 149 and the motor 150) form a unit as the lifting and lowering mechanism. The driving members (the gears 144 to 149 and the motor 150) are housed in the lifting and lowering driving box 160.

The upper limit detecting sensor 141 and the lower limit detecting sensor 142 are attached to the outer surface of the lifting and lowering driving box 160. The lifting and lowering driving box 160, the tray lifting and lowering lever 106, and the fulcrum shaft 117 are attached to the base 116. The gear 143 on the tray lifting and lowering lever and the gear 144 coupled thereto are coupled through a notch provided in the base 116. The base 116 to which the members are attached can be attached to the housing center frame 119 on the downstream side in the sheet discharge direction crossing the lifting and lowering direction of the first stack tray 35 (on the rear side in the drawing).

According to the above composition, the phase alignment during the assembling of the rack & pinion type and the belt & pinion type becomes unnecessary. The stacking portion is connected detachably to the housing portion and the lifting and lowering mechanism on the downstream side in the sheet discharge direction crossing the lifting and lowering direction of the first stack tray 35. In the state that the stacking portion is not attached, the lifting and lowering mechanism is connected detachably to the housing portion on the downstream side in the sheet discharge direction. The lifting and lowering mechanism of the sheet processing apparatus is connected detachably within the sheet stacking and sheet takeout space. The lifting and lowering mechanism of the sheet processing apparatus can be excellent in the assembly properties and the maintenance properties.

Figure 11B:
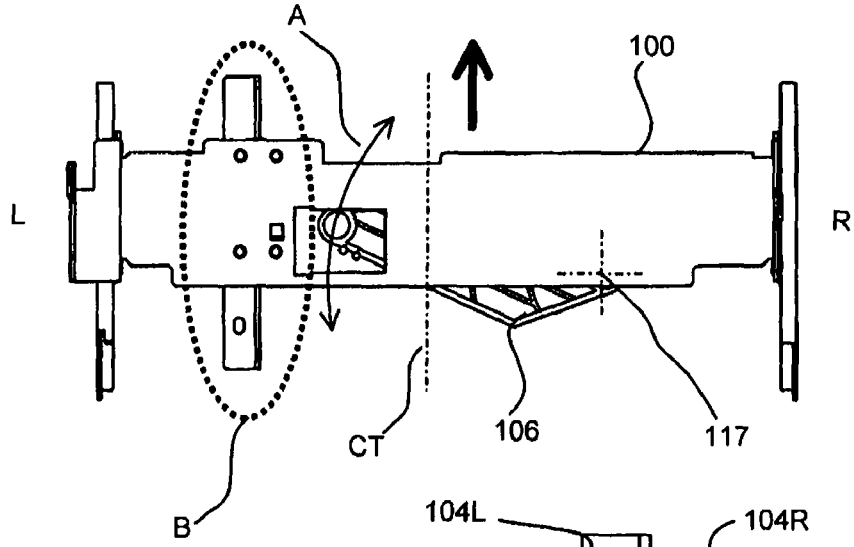
Figure 11C:
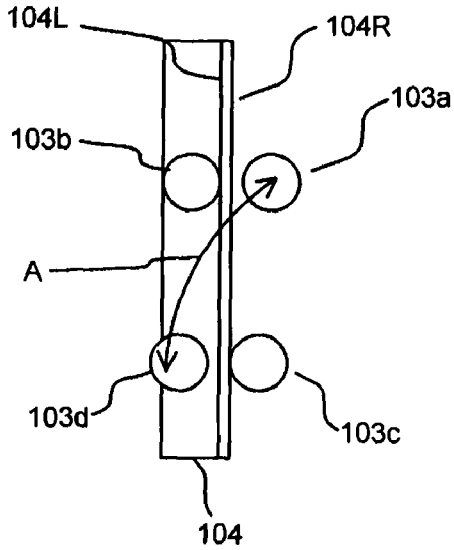

FIGS. 11A, 11B, and 11C are diagrams of the tray lifting and lowering mechanism seen from the tray. FIG. 11A illustrates the state that the tray coupling member 100 is lowered to the lower limit position, FIG. 11B illustrates the state that the tray coupling member 100 is being lifted, and FIG. 11C illustrates the relation between the YZ load supporting roller 103 and the YZ load supporting rail 104 as the restricting portion (the B portion of FIG. 11B).

As illustrated in FIG. 11A, the tray lifting and lowering lever 106 on the lower side is rotated clockwise about the fulcrum shaft 117 by the driving force from the motor 150 (FIG. 10A) in the YZ plane which is parallel to the stacking wall 109. As illustrated in FIG. 11B, the lifting and lowering roller 107 lifts the upper side of the hole portion 118 of the tray coupling member 100. The tray coupling member 100 is then lifted upward.

In FIGS. 11A, 11B, and 11C, the center in the width direction between the XZ load supporting rails 102 is indicated by CT, the right side is indicated by R, and the left side is indicated by L.

The fulcrum shaft 117 of the tray lifting and lowering lever 106 is located on the R side from the center CT. The lifting and lowering roller 107 which is abutted onto and lifts the tray coupling member 100 is located on the L side from the center CT. The tray coupling member 100 receives the rotational force clockwise from the tray lifting and lowering lever 106 on the L side from the center CT to receive the force tilting the tray coupling member 100 in the direction indicated by the arrow A.

As illustrated in FIG. 11C, to receive the force, the YZ load supporting roller 103 is arranged as the restricting portion such that upon reception of the force at rotation of the tray lifting and lowering lever 106 in the upward direction indicated by the arrow A, the tray coupling member 100 is not tilted in the direction indicated by the arrow A. The YZ load supporting rail 104 with which the YZ load supporting roller 103 is engaged has a guide surface in the XZ plane perpendicular to the guide surface of the XZ load supporting rail 102. The tray coupling member 100 receives the rotational force of the tray lifting and lowering lever 106. The YZ load supporting rail 104 restricts the rattling of the tray coupling member 100 in the YZ direction crossing the lifting and lowering direction of the first stack tray 35.

A pair of rotating members (YZ load supporting rollers 103*a* and 103*b*) are opposite so as to interpose the YZ load supporting rail 104 therebetween. A pair of rotating members (YZ load supporting rollers 103*c* and 103*d*) are opposite so as to interpose the YZ load supporting rail 104 therebetween. The plurality of pairs of the YZ load supporting rollers 103 are provided along the lifting and lowering direction of the first stack tray 35.

As illustrated in FIG. 11C, among the plurality of pairs (here, two pairs) of the YZ load supporting rollers 103, the YZ load supporting rail 104 is nipped by the roller 103*b* of the upper pair in the lifting and lowering direction of the first stack tray 35 and the roller 103*c* of the lower pair in the lifting and lowering direction. Among the pairs of the YZ load supporting rollers 103, the roller 103*b* and the roller 103*c* are rollers which suppress rotation when the tray coupling member 100 receives the upward force by the tray lifting and lowering lever 106. The roller 103*b* is abutted onto a 104L side of the YZ load supporting rail 104. The roller 103*c* is abutted onto a 104R side. A predetermined gap is provided between the roller 103*a* of the upper pair in the lifting and lowering direction and the YZ load supporting rail 104. A predetermined gap is provided between the roller 103*d* of the lower pair in the lifting and lowering direction and the YZ load supporting rail 104. The moving load (the load of the motor) in the up and down direction of the first stack tray 35 due to friction between the YZ load supporting roller 103 and the YZ load supporting rail 104 can be reduced to eliminate the tilting of the first stack tray 35.

The sheet processing apparatus moves the sheet to the R side to staple it. The R side including the weight of the staple becomes heavy to receive the force in the direction indicated by the arrow A illustrated in FIGS. 11A, 11B, and 11C from the center of gravity of the stacked sheet. The fulcrum shaft 117 of the tray lifting and lowering lever 106 is provided on the R side. Depending on the center of gravity of the stacked sheet, the fulcrum shaft of the tray lifting and lowering lever 106 may be provided on the L side.

As described above, according to this embodiment, the tray is supported only by the rollers and the rails so as to be lifted and lowered. No expensive parts such as a belt are used, which reduces the cost. In the assembled state, the roller of the lifting and lowering lever has only to engage the tray supporting members. The phase alignment in the related art is unnecessary. This brings about excellent assembly properties of the tray to the apparatus body.

Second Embodiment

Figure 12A:
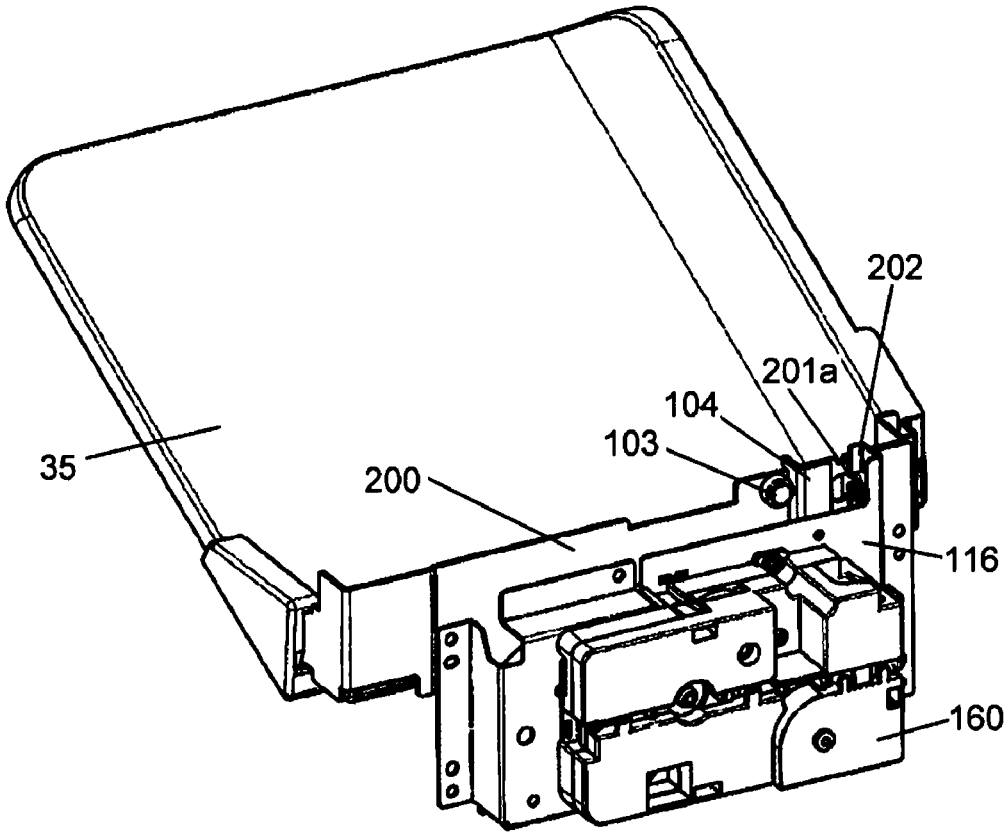
FIGS. 12A and 12B are perspective views of the stacking portion and the lifting and lowering mechanism of the sheet processing apparatus (sheet stacking apparatus) according to a second embodiment.
Figure 12B:
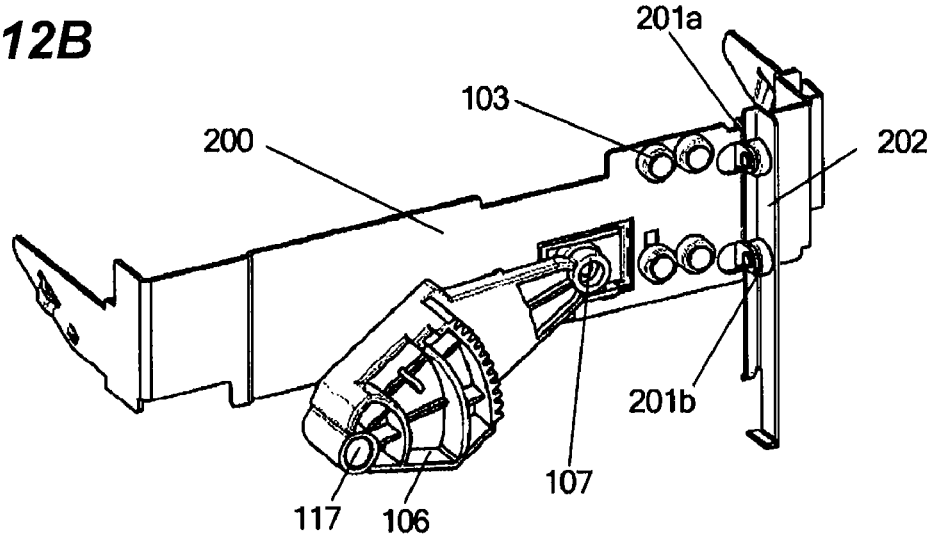

A second embodiment will be described using the drawings. FIGS. 12A and 12B are perspective views of the stacking portion and the lifting and lowering mechanism of the sheet processing apparatus (sheet stacking apparatus) according to the second embodiment. FIG. 12B is a diagram in which a first stack tray 35, a lifting and lowering driving box 160, and a base 116 are removed from FIG. 12A. The same composition as that of the first embodiment is indicated by the same reference numerals, and the description will not be repeated here.

As illustrated in FIGS. 12A and 12B, a tray coupling member (a coupling member) 200 of this embodiment has an XZ load supporting roller 201*a*, and an XZ load supporting roller 201*b*. An XZ load supporting roller 201 is operated in the same manner as the XZ load supporting roller 101 of the first embodiment. An XZ load supporting rail 202 of this embodiment is operated in the same manner as the XZ load supporting rail 102 of the first embodiment.

In the first embodiment, the XZ load supporting rail 102 is disposed in the housing portion. In this embodiment, the XZ load supporting rail 202 is formed integrally with the base 116 which composes the lifting and lowering mechanism along the lifting and lowering direction of the first stack tray 35. The driving members (gears 144 to 149 and a motor 150), the members (the base 116 and the lifting and lowering driving box 160) which support the driving members, and the rail member can form a unit. All the members related to the lifting and lowering function are connected detachably as a unit to the housing portion.

As described above, the XZ load supporting rail 202 may be provided in one position. A part or all of the XZ supporting rail may be formed by a part of the housing frame or the base 116 in the lifting and lowering mechanism. The XZ load supporting roller 101 which composes the connecting portion which supports the XZ load may be a sliding member, not a rolling member such as a roller. The driving member may be of the rack & pinion type or the belt & pulley type.

In the above composition, the stacking portion is connected detachably to the discharge portion and the lifting and lowering mechanism on the downstream side in the sheet discharge direction. The stacking portion can be assembled in a direction crossing the lifting and lowering direction of the first stack tray 35 without changing the installing posture of the lifting and lowering mechanism. This results in improvement of workability.

Third Embodiment

Figure 13:
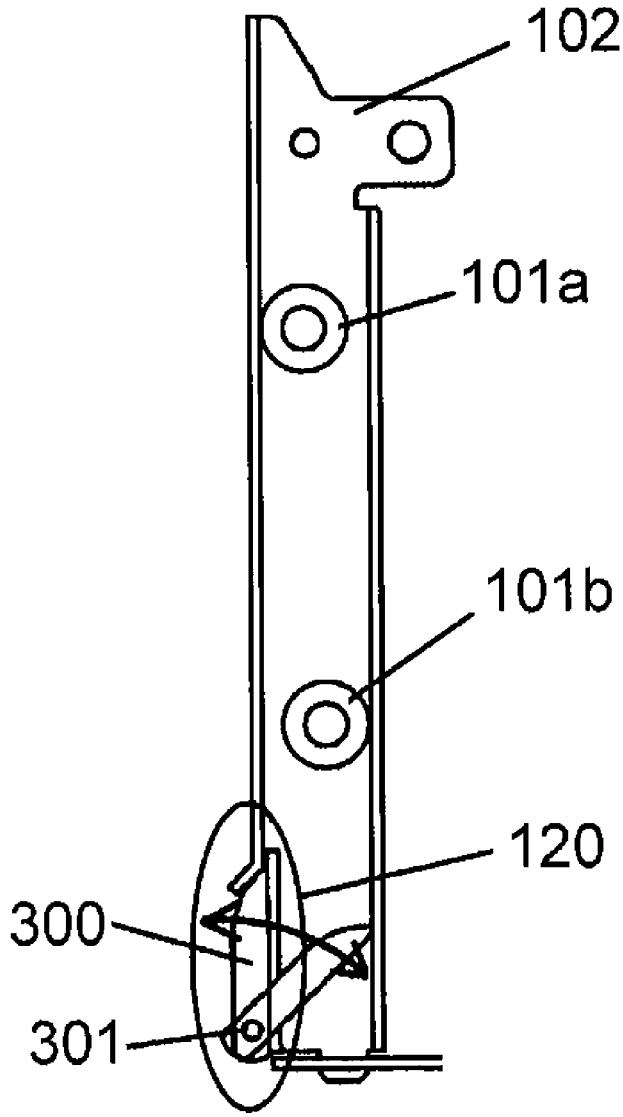
FIG. 13 is a diagram describing the sheet processing apparatus (sheet stacking apparatus) according to a third embodiment.

A third embodiment will be described with reference to the drawing. FIG. 13 is a diagram describing the sheet processing apparatus (the sheet stacking apparatus) according to the third embodiment. In FIG. 13, an XZ load supporting roller 101 and an XZ load supporting rail 102 are seen in the sheet width direction. The same composition as that of the above embodiments is indicated by the same reference numerals, and the description will not be repeated here.

As illustrated in FIG. 13, in this embodiment, a cover member 121 is disposed at the lower end of the XZ load supporting rail 102. The cover member 121 is integrated with the XZ load supporting rail 102 and closes a notch 120 in the assembled state. The cover member 121 can be rotated about a fulcrum 122. During assembling, the XZ load supporting roller 101 can press the cover member 121 so as to pass through the notch 120. The assembled cover member 121 is abutted onto the lower end of the XZ load supporting rail 102 from the opposite side of the passing direction of the XZ load supporting roller 101 during assembling, and is then held. The notch 120 is closed to prevent the XZ load supporting roller 101 from passing through the notch 120 in the reverse direction to assembling.

Fourth Embodiment

Figure 14:
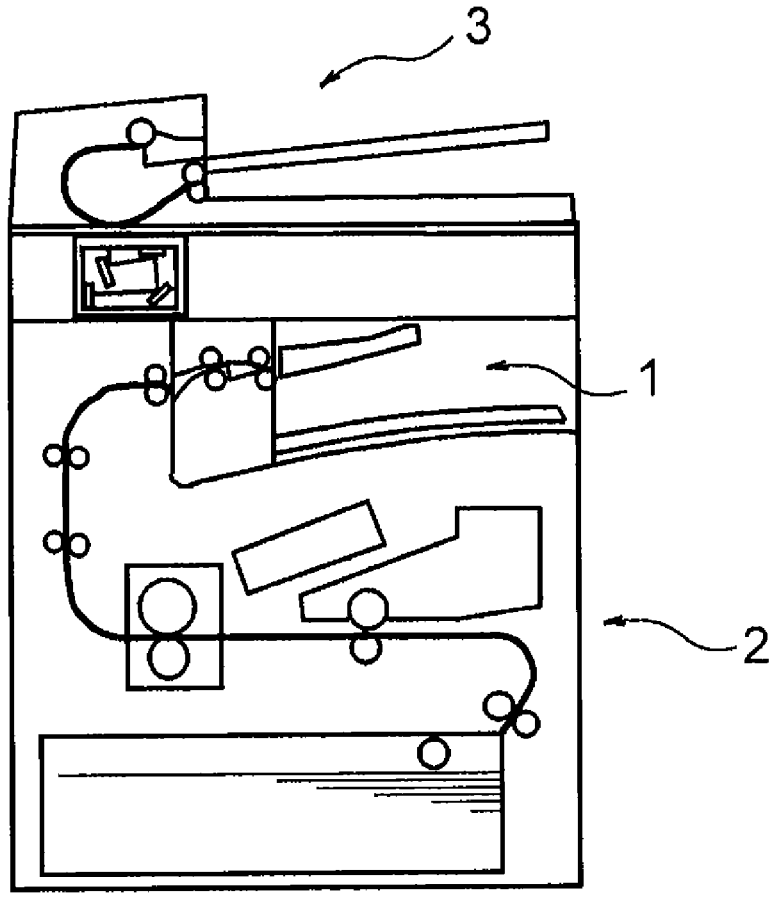
FIG. 14 is a schematic sectional view of the image forming apparatus according to a fourth embodiment.

FIG. 14 is a schematic sectional view of the image forming apparatus according to a fourth embodiment. The image forming apparatus illustrated in FIG. 14 has a sheet processing apparatus 1 as a sheet stacking apparatus, an image forming apparatus body 2 which forms an image on the sheet, and an image reading portion 3 which can be connected to the image forming apparatus body 2 and reads the described information on the original (on the sheet).

A recessed space is provided between the image forming apparatus body 2 and the image reading portion 3 which include the image forming portion. The image formed sheet S is discharged into the recessed space (sheet discharge space). The composition of the image forming apparatus body 2 and the image reading portion 3 illustrated in FIG. 14 is a internal discharge type image forming apparatus. The sheet processing apparatus 1 can be installed in the recessed space. The stacking portion and the lifting and lowering mechanism in the sheet processing apparatus 1 have the same composition as the above embodiments. When being installed in the image forming apparatus body, the stacking portion or the stacking portion and the lifting and lowering mechanism are connected detachably within the sheet stacking and sheet takeout space. By this, excellent maintenance properties can be realized without detaching many peripheral members.

Figure 15A:
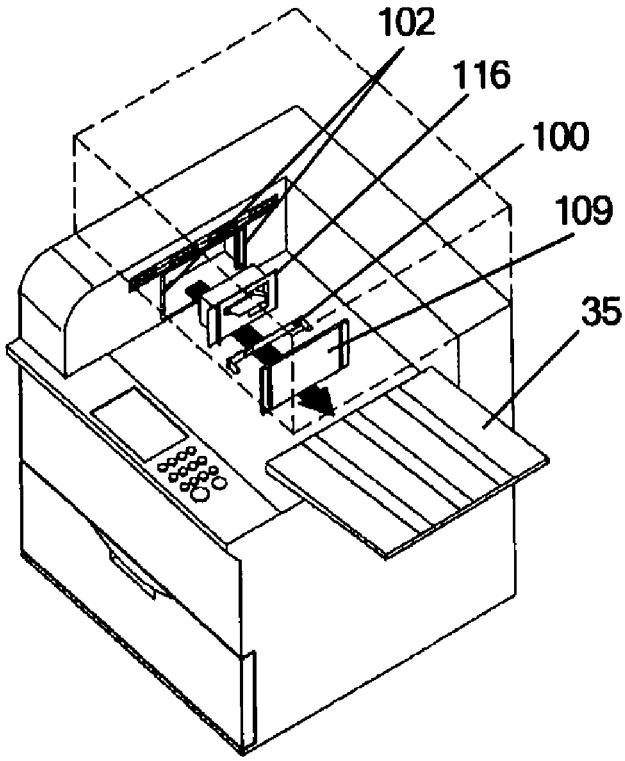
FIGS. 15A and 15B are exploded views of the sheet stacking apparatus according to the fourth embodiment.
Figure 15B:
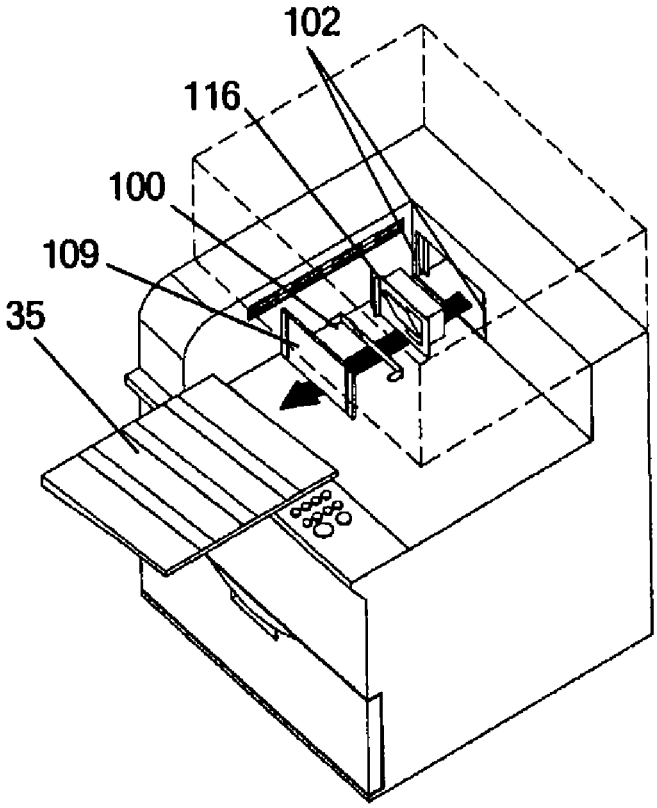

In the internal discharge type image forming apparatus, regardless of the existence of the image forming apparatus body and the image reading portion on the upper and lower sides of the sheet stacking space, the stacking portion and the lifting and lowering mechanism in the present invention can be detached without being lifted and lowered to the outside of the sheet stacking range. As in the example illustrated in FIGS. 15A and 15B, maintenance is enabled without requiring to disassemble the peripheral members. FIGS. 15A and 15B are exploded views of the sheet stacking apparatus of this embodiment. As illustrated in FIG. 15B, the lifting and lowering mechanism is arranged on the rear side in the sheet stacking space. As described above, the stacking portion or the stacking portion and the lifting and lowering mechanism are connected detachably. In FIGS. 15A and 15B, the image reading portion is indicated by a dashed line for convenience.

In the above, regarding the embodiment, description has been made of structure where the sheet stacking apparatus is incorporated into the sheet processing apparatus. The sheet stacking apparatus according to the present invention structured so as to be incorporated into the image forming apparatus body is also applicable.

Fifth Embodiment

Figure 16A:
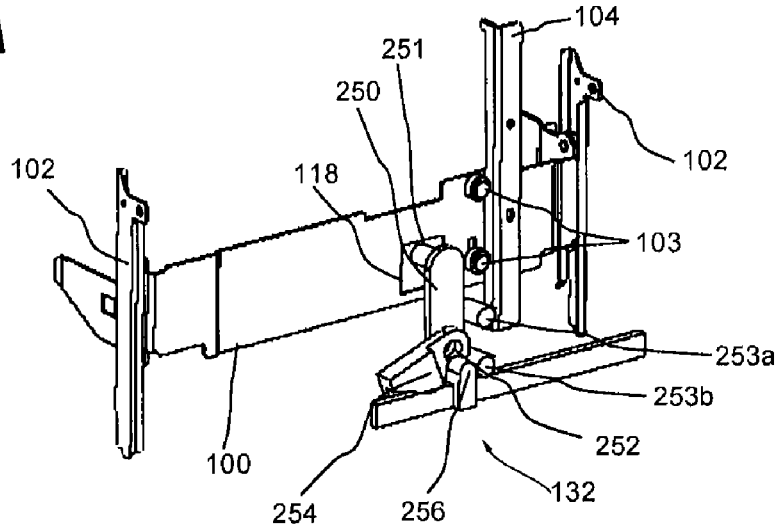
FIGS. 16A, 16B, and 16C are diagrams of the tray lifting and lowering mechanism according to a fifth embodiment seen from the tray.
Figure 16B:
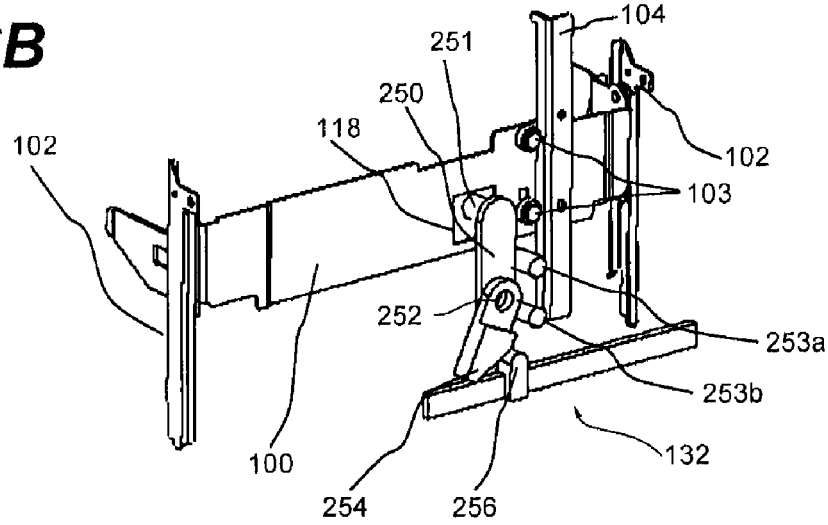
Figure 16C:
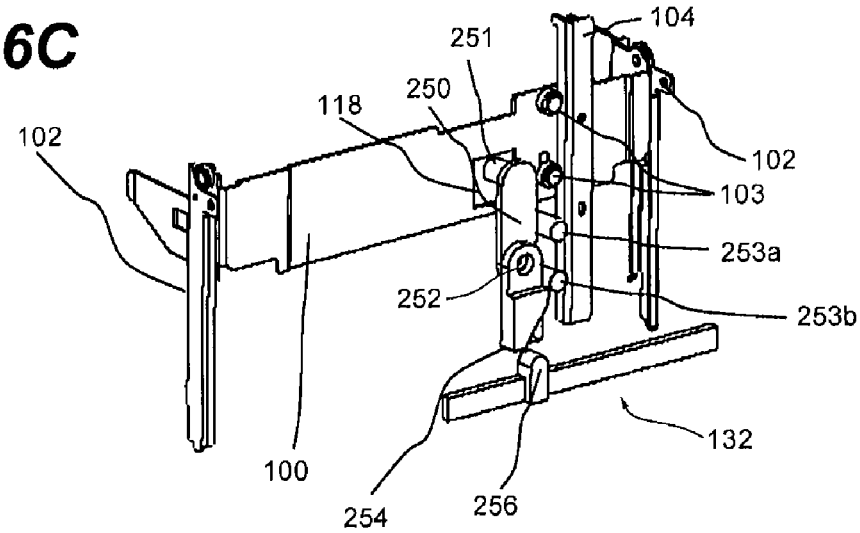

Referring now to FIGS. 16A, 16B, and 16C, the tray lifting and lowering mechanism according to a fifth embodiment will be described. FIGS. 16A, 16B, and 16C are diagrams of the tray lifting and lowering mechanism of the fifth embodiment seen from the tray. FIG. 16A illustrates the state that the tray coupling member 100 is lowered to the lower limit position. FIG. 16B illustrates the state that the tray coupling member 100 is being lifted. FIG. 16C illustrates the state that the tray coupling member 100 is lifted to the upper limit position. The composition other than the tray lifting and lowering mechanism is similar to the image forming apparatus and the sheet processing apparatus in the above embodiments, and the description will not be repeated here. Also, the members having the same function are indicated by the same reference numerals, and the description will not be repeated here.

As illustrated in FIGS. 16A, 16B, and 16C, a lifting and lowering mechanism 132 has driving gears 253*a* and 253*b* which are rotated forwardly and reversely about the axis in a direction perpendicular to the stacking wall 109 by the driving force from the driving source. The lifting and lowering mechanism 132 has rack gears 250 and 254 which are engaged with the driving gears 253*a* and 253*b* and are guided by the rollers and the rails in the up and down direction which is the moving direction of the first stack tray 35. The second rack gear 254 is coupled to the first rack gear 250 so as to be rotated about a fulcrum 252. A cam 256 which can be abutted onto the second rack gear 254 is arranged on the lower side of the moving direction of the rack gears 250 and 254. The cam 256 is provided on the base of the apparatus body. When the first stack tray 35 is lowered, the second rack gear 254 is abutted onto the cam 256 and is then folded to one side in the width direction relative to the first rack gear 250 so as to be housed. A shaft 251 as an engaging portion is provided on the first rack gear 250. The shaft 251 of the first rack gear 250 is engaged with the hole portion 118 provided in the tray coupling member 100. The rack gears 250 and 254 are moved in the up and down directions by the rotation of the driving gears 253*a* and 253*b*. The shaft 251 is moved in the same direction. The first stack tray 35 is moved in the up and down directions.

In FIG. 16A, the tray coupling member 100 is lowered to the lower limit position. Only the first rack gear 250 and the driving gear 253*b* are engaged. The second rack gear 254 is abutted onto the cam 256 and is then folded to one side in the width direction so as to be housed. When the first stack tray 35 is lowered to the lower limit position, the rack gear is prevented from jumping out from the lower side of the apparatus.

In FIG. 16B, the driving gears 253*a* and 253*b* are rotated clockwise and the first rack gear 250 is moved upward. With the upward movement of the first rack gear 250, the shaft 251 and the hole portion 118 are engaged to move the tray coupling member 100 upward. The second rack gear 254 is urged clockwise relative to the fulcrum 252 of the first rack gear 250 and is then rotated clockwise from the position illustrated in FIG. 16A.

In FIG. 16C, the driving gears 253*a* and 253*b* are rotated clockwise and the first rack gear 250 is moved upward. The second rack gear 254 is moved away from the cam 256 and is rotated clockwise from the position illustrated in FIG. 16B. The angle formed between the first rack gear 250 and the second rack gear 254 is 0°. The first rack gear 250 and the second rack gear 254 are brought into the same state as one long rack gear. In FIG. 16C, the first rack gear 250 and the driving gear 253*a* are engaged, and the second rack gear 254 and the driving gear 253*b* are also engaged.

According to this embodiment, the rack gear which composes the tray lifting and lowering mechanism can be folded. As in the rotating type lifting and lowering lever of the above embodiment, an inexpensive lifting and lowering mechanism can be arranged on the opposite side of the stack tray so as to interpose the stacking wall 109 therebetween while securing the sufficient amount of lifting and lowering.

Sixth Embodiment

Figure 17A:
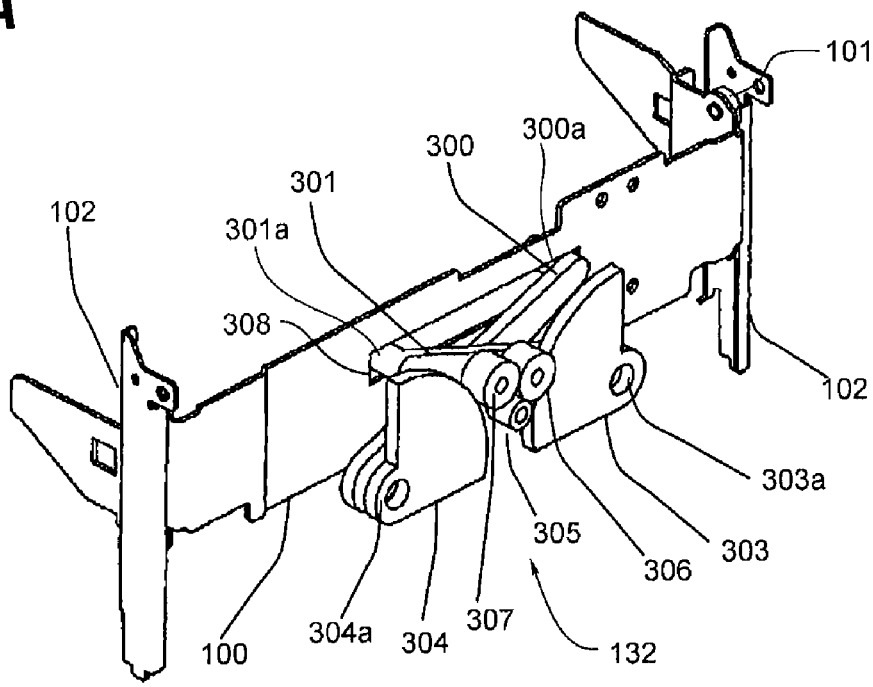
FIGS. 17A and 17B are diagrams of the tray lifting and lowering mechanism according to a sixth embodiment seen from the tray.
Figure 17B:
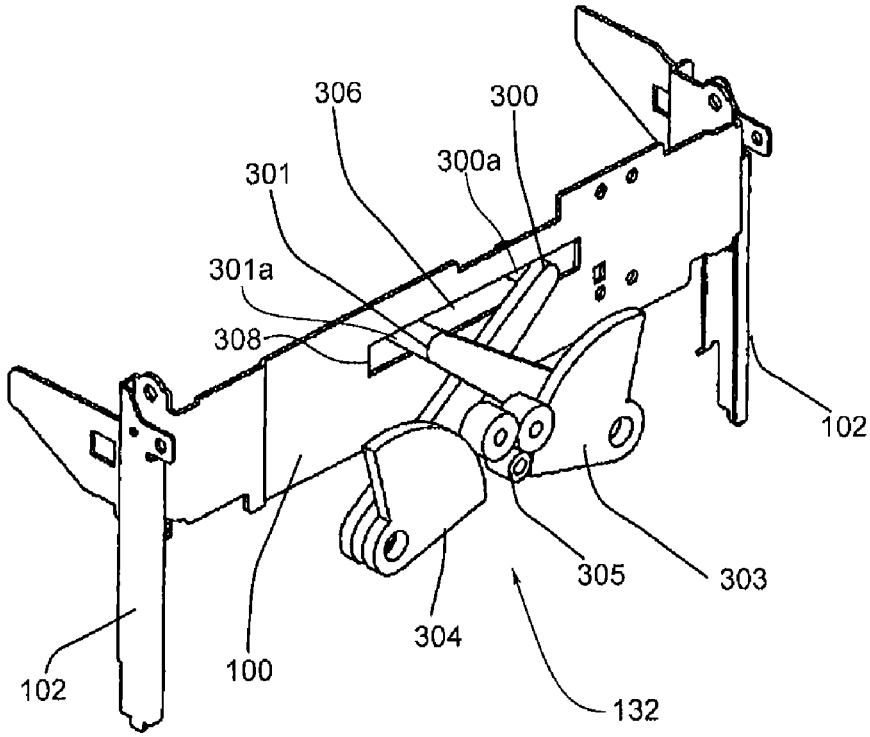

Referring now to FIGS. 17A and 17B, the tray lifting and lowering mechanism according to a sixth embodiment will be described. FIGS. 17A and 17B are diagrams of the tray lifting and lowering mechanism of the sixth embodiment seen from the tray. FIG. 17A illustrates the state that the tray coupling member 100 is lowered to the lower limit position. FIG. 17B illustrates the state that the tray coupling member 100 is being lifted. The sixth embodiment is substantially the same as the above embodiments except that the image forming apparatus and the sheet processing apparatus other than the lifting and lowering mechanism have a set of rollers and a set of rails corresponding to the first rotating member and the first rail member, and the description will not be repeated here. Also, the members having the same function are indicated by the same reference numerals, and the description will not be repeated here.

As illustrated in FIGS. 17A and 17B, the lifting and lowering mechanism 132 has lever members 300 and 301 which are rotated forwardly and reversely about fulcrum shafts 303*a* and 304*a* which are shafts in a direction perpendicular to the stacking wall 109 by the driving force from the driving source. The shafts 300*a* and 301*a* are provided at the top ends of the lever members 300 and 301. The shafts 300*a* and 301*a* as the engaging portion engage a laterally long slit 308 provided in the center in the width direction of the tray coupling member 100. Fan-type gears 303 and 304 are provided integrally with on the lever members 300 and 301. The fan-type gears 303 and 304 are integrally rotated about the fulcrum shafts 303*a* and 304*a*. The lever members 300 and 301 are provided symmetrically with respect to the center in the width direction of the tray coupling member 100. The lever members 300 and 301 are symmetrically provided so as to move the first stack tray 35 in the up and down directions.

A driving gear 305 is rotated forwardly and reversely by the driving force from the driving source. When the tray coupling member 100 is moved upward, the driving gear 305 is rotated clockwise. When the tray coupling member 100 is moved downward, the driving gear 305 is rotated counterclockwise. The driving gear 305 is engaged with a gear 306. The gear 306 is engaged with the fan-type gear 303. The gear 306 is engaged with a gear 307. The gear 307 is engaged with the fan-type gear 304. The driving gear 305 is rotated clockwise. Both the lever members 300 and 301 are rotated so as to move the tray coupling member 100 upward and are rotated counterclockwise. Both the lever members 300 and 301 are rotated so as to move the tray coupling member 100 downward.

The lever members 300 and 301 provided symmetrically with respect to the center in the width direction are rotated symmetrically about the fulcrum shafts 303*a* and 304*a* forwardly and reversely. The shafts 300*a* and 301*a* are moved in the slit 308 while restricting the rattling in a direction crossing the lifting and lowering direction of the first stack tray 35. The XZ load supporting rail 102 as the rail member and the XZ load supporting roller 101 as the rotating member guide the tray coupling member 100. The tray coupling member 100 is moved in the up and down directions so as not to be tilted. Both the lever members 300 and 301 function as the restricting unit to move the tray coupling member 100.

As described above, according to this embodiment, the laterally long slit 308 provided in the tray coupling member 100 and the two symmetric lever members 300 and 301 are engaged in two positions. While the tray coupling member 100 is lifted and lowered, the rotational force in the YZ direction is received to restrict the rattling. As in the above embodiments, the lifting and lowering mechanism is arranged on the rear side of the stacking surface to suppress the tilting of the first stack tray 35. By this, the second rotating member and the second rail member as the restricting portion of the above form become unnecessary. Furthermore, a more inexpensive lifting and lowering mechanism can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-316924, filed Dec. 7, 2007, No. 2008-032545, filed Feb. 14, 2008, No. 2008-289458, filed Nov. 12, 2008 which are hereby incorporated by reference in their entirety.

What is claimed is:

1. A sheet stacking apparatus comprising:

a stacking portion on which a discharged sheet is stacked;

a housing portion which can support the stacking portion so as to lift and lower the stacking portion; and a lifting and lowering mechanism which lifts and lowers the stacking portion, wherein the stacking portion has a connecting portion which connects the stacking portion to the housing portion, the connecting portion can connect the stacking portion to the housing portion in a direction crossing the lifting and lowering direction of the stacking portion, the housing portion has a guide member which is extended in the lifting and lowering direction of the stacking portion, the connecting portion is connected detachably to the guide member in a direction crossing the lifting and lowering direction of the stacking portion, and the guide member comprises a rail member having two opposed guide surfaces which are engaged with the connecting portion, and the rail member has a notch which is opened in a direction crossing the lifting and lowering direction of the stacking portion such that the connecting portion can pass therethrough.

2. The sheet stacking apparatus according to claim 1, wherein the stacking portion has a stack tray on which the sheet is stacked and a coupling member which couples the stack tray and the guide member, and wherein the connecting portion is provided on the coupling member.

3. The sheet stacking apparatus according to claim 2, further comprising:

a stacking wall onto which the end of the stacked sheet is abutted, wherein the lifting and lowering mechanism is arranged on the opposite side of the stack tray so as to interpose the stacking wall therebetween and lifts and lowers the coupling member.

4. The sheet stacking apparatus according to claim 1, further comprising:

a stacking wall onto which the end of the sheet stacked on the stack tray is abutted, wherein the notch provided in the rail member is closed by the stacking wall.

5. The sheet stacking apparatus according to claim 1, wherein the rail member has a cover member which closes the notch.

6. A sheet processing apparatus comprising:

an intermediate stacking portion on which a sheet is stacked;

a sheet processing portion which processes the sheet stacked on the intermediate stacking portion; and a sheet stacking apparatus on which the processed sheet is stacked, the sheet stacking apparatus comprising:

a stacking portion on which a discharged sheet is stacked;

a housing portion which can support the stacking portion so as to lift and lower the stacking portion; and a lifting and lowering mechanism which lifts and lowers the stacking portion, wherein the stacking portion has a connecting portion which connects the stacking portion to the housing portion, the connecting portion can connect the stacking portion to the housing portion in a direction crossing the lifting and lowering direction of the stacking portion, the housing portion has a guide member which is extended in the lifting and lowering direction of the stacking portion, the connecting portion is connected detachably to the guide member in a direction crossing the lifting and lowering direction of the stacking portion, and the guide member comprises a rail member having two opposed guide surfaces which are engaged with the connecting portion, and the rail has a notch which is opened in a direction crossing the lifting and lowering direction of the stacking portion such that the connecting portion can pass therethrough.

7. An image forming apparatus comprising:

an image forming portion which forms an image on a sheet; and a sheet processing apparatus which processes the sheet on which the image is formed, wherein the sheet processing apparatus comprises:

an intermediate stacking portion on which a sheet is stacked;

a sheet processing portion which processes the sheet stacked on the intermediate stacking portion; and a sheet stacking apparatus on which the processed sheet is stacked, wherein the sheet stacking apparatus comprises:

a stacking portion on which a discharged sheet is stacked;

a housing portion which can support the stacking portion so as to lift and lower the stacking portion; and a lifting and lowering mechanism which lifts and lowers the stacking portion, wherein the stacking portion has a connecting portion which connects the stacking portion to the housing portion, the connecting portion can connect the stacking portion to the housing portion in a direction crossing the lifting and lowering direction of the stacking portion, the housing portion has a guide member which is extended in the lifting and lowering direction of the stacking portion, the connecting portion is connected detachably to the guide member in a direction crossing the lifting and lowering direction of the stacking portion, and the guide member comprises a rail member having two opposed guide surfaces which are engaged with the connecting portion, and the rail has a notch which is opened in a direction crossing the lifting and lowering direction of the stacking portion such that the connecting portion can pass therethrough.

8. An image forming apparatus comprising:

an image forming portion which forms an image on a sheet; and a sheet stacking apparatus on which the sheet with an image formed is stacked, wherein the sheet stacking apparatus comprises:

a stacking portion on which a discharged sheet is stacked;

a housing portion which can support the stacking portion so as to lift and lower the stacking portion; and a lifting and lowering mechanism which lifts and lowers the stacking portion, wherein the stacking portion has a connecting portion which connects the stacking portion to the housing portion, the connecting portion can connect the stacking portion to the housing portion in a direction crossing the lifting and lowering direction of the stacking portion, the housing portion has a guide member which is extended in the lifting and lowering direction of the stacking portion, the connecting portion is connected detachably to the guide member in a direction crossing the lifting and lowering direction of the stacking portion, and the guide member comprises a rail member having two opposed guide surfaces which are engaged with the connecting portion, and the rail has a notch which is opened in a direction crossing the lifting and lowering direction of the stacking portion such that the connecting portion can pass therethrough.

9. A sheet stacking apparatus comprising:

a stacking portion on which a discharged sheet is stacked;

a lifting and lowering mechanism which lifts and lowers the stacking portion and can support the stacking portion so as to lift and lower the stacking portion; and a housing portion which can support the lifting and lowering mechanism, wherein the stacking portion has a connecting portion which connects the stacking portion to the housing portion, the connecting portion can connect the stacking portion to the lifting and lowering mechanism in a direction crossing the lifting and lowering direction of the stacking portion, the lifting and lowering mechanism has a guide member which is extended in the lifting and lowering direction of the stacking portion, the connecting portion is connected detachably to the guide member in a direction crossing the lifting and lowering direction of the stacking portion, and the guide member comprises a rail member having two opposing guide surfaces which are engaged with the connecting portion, and the rail member has a notch which is opened in a direction crossing the lifting and lowering direction of the stacking portion such that the connecting portion can pass therethrough.

10. The sheet stacking apparatus according to claim 9, wherein the stacking portion has a stack tray which stacks the sheet thereon and a coupling member which couples the stack tray and the guide member, and wherein the connecting portion is provided on the coupling member.

11. The sheet stacking apparatus according to claim 10, further comprising:

a stacking wall onto which the end of the stacked sheet is abutted, wherein the lifting and lowering mechanism is arranged on the opposite side of the stack tray so as to interpose the stacking wall therebetween and lifts and lowers the coupling member.

12. The sheet stacking apparatus according to claim 9, further comprising:

a stacking wall onto which the end of the sheet stacked on the stack tray is abutted, wherein the notch provided in the rail member is closed by the stacking wall.

13. The sheet stacking apparatus according to claim 9, wherein the rail member has a cover member which closes the notch.

14. A sheet processing apparatus comprising:

an intermediate stacking portion on which a sheet is stacked;

a sheet processing portion which processes the sheet stacked on the intermediate stacking portion; and a sheet stacking apparatus on which the processed sheet is stacked, wherein the sheet stacking apparatus comprises:

a stacking portion on which a discharged sheet is stacked;

a lifting and lowering mechanism which lifts and lowers the stacking portion and can support the stacking portion so as to lift and lower the stacking portion; and a housing portion which can support the lifting and lowering mechanism, wherein the stacking portion has a connecting portion which connects the stacking portion to the housing portion, the connecting portion can connect the stacking portion to the lifting and lowering mechanism in a direction crossing the lifting and lowering direction of the stacking portion, the lifting and lowering mechanism has a guide member which is extended in the lifting and lowering direction of the stacking portion, the connecting portion is connected detachably to the guide member in a direction crossing the lifting and lowering direction of the stacking portion, and the guide member comprises a rail member having two opposed guide surfaces which are engaged with the connecting portion, and the rail has a notch which is opened in a direction crossing the lifting and lowering direction of the stacking portion such that the connecting portion can pass therethrough.

15. An image forming apparatus comprising:

an image forming portion which forms an image on a sheet; and a sheet processing apparatus which processes the sheet on which the image is formed, wherein the sheet processing apparatus comprises:

an intermediate stacking portion on which a sheet is stacked;

a sheet processing portion which processes the sheet stacked on the intermediate stacking portion; and a sheet stacking apparatus on which the processed sheet is stacked, wherein the sheet stacking apparatus comprises:

a stacking portion on which a discharged sheet is stacked;

a lifting and lowering mechanism which lifts and lowers the stacking portion and can support the stacking portion so as to lift and lower the stacking portion; and a housing portion which can support the lifting and lowering mechanism, wherein the stacking portion has a connecting portion which connects the stacking portion to the housing portion, the connecting portion can connect the stacking portion to the lifting and lowering mechanism in a direction crossing the lifting and lowering direction of the stacking portion, the lifting and lowering mechanism has a guide member which is extended in the lifting and lowering direction of the stacking portion, the connecting portion is connected detachably to the guide member in a direction crossing the lifting and lowering direction of the stacking portion, and the guide member comprises a rail member having two opposed guide surfaces which are engaged with the connecting portion, and the rail has a notch which is opened in a direction crossing the lifting and lowering direction of the stacking portion such that the connecting portion can pass therethrough.

16. An image forming apparatus comprising:

an image forming portion which forms an image on a sheet; and a sheet stacking apparatus on which the sheet with an image formed is stacked, wherein the sheet stacking apparatus comprises:

a stacking portion on which a discharged sheet is stacked;

a lifting and lowering mechanism which lifts and lowers the stacking portion and can support the stacking portion so as to lift and lower the stacking portion; and a housing portion which can support the lifting and lowering mechanism, wherein the stacking portion has a connecting portion which connects the stacking portion to the housing portion, the connecting portion can connect the stacking portion to the lifting and lowering mechanism in a direction crossing the lifting and lowering direction of the stacking portion, the lifting and lowering mechanism has a guide member which is extended in the lifting and lowering direction of the stacking portion, the connecting portion is connected detachably to the guide member in a direction crossing the lifting and lowering direction of the stacking portion, and the guide member comprises a rail member having two opposed guide surfaces which are engaged with the connecting portion, and the rail has a notch which is opened in a direction crossing the lifting and lowering direction of the stacking portion such that the connecting portion can pass therethrough.

17. A sheet stacking apparatus comprising:

a stacking portion on which a discharged sheet is stacked;

a housing portion which can support the stacking portion so as to lift and lower the stacking portion; and a lifting and lowering mechanism which lifts and lowers the stacking portion, wherein the stacking portion has a connecting portion which connects the stacking portion to the housing portion, the connecting portion can connect the stacking portion to the housing portion in a direction crossing the lifting and lowering direction of the stacking portion, and the lifting and lowering mechanism has a restricting portion which restricts rattling in a direction crossing the lifting and lowering direction of the stacking portion.

18. A sheet processing apparatus comprising:

an intermediate stacking portion on which a sheet is stacked;

a sheet processing portion which processes the sheet stacked on the intermediate stacking portion; and a sheet stacking apparatus on which the processed sheet is stacked, the sheet stacking apparatus comprising:

a stacking portion on which a discharged sheet is stacked;

a housing portion which can support the stacking portion so as to lift and lower the stacking portion;

a lifting and lowering mechanism which lifts and lowers the stacking portion, wherein the stacking portion has a connecting portion which connects the stacking portion to the housing portion, the connecting portion can connect the stacking portion to the housing portion in a direction crossing the lifting and lowering direction of the stacking portion, and the lifting and lowering mechanism has a restricting portion which restricts rattling in a direction crossing the lifting and lowering direction of the stacking portion.

19. An image forming apparatus comprising:

an image forming portion which forms an image on a sheet; and a sheet processing apparatus which processes the sheet on which the image is formed, wherein the sheet processing apparatus comprises:

an intermediate stacking portion on which a sheet is stacked;

a sheet processing portion which processes the sheet stacked on the intermediate stacking portion; and a sheet stacking apparatus on which the processed sheet is stacked, wherein the sheet stacking apparatus comprises:

a stacking portion on which a discharged sheet is stacked;

a housing portion which can support the stacking portion so as to lift and lower the stacking portion; and a lifting and lowering mechanism which lifts and lowers the stacking portion, wherein the stacking portion has a connecting portion which connects the stacking portion to the housing portion, the connecting portion can connect the stacking portion to the housing portion in a direction crossing the lifting and lowering direction of the stacking portion, and the lifting and lowering mechanism has a restricting portion which restricts rattling in a direction crossing the lifting and lowering direction of the stacking portion.

20. An image forming apparatus comprising:

an image forming portion which forms an image on a sheet; and a sheet stacking apparatus on which the sheet with an image formed is stacked, wherein the sheet stacking apparatus comprises:

a stacking portion on which a discharged sheet is stacked;

a housing portion which can support the stacking portion so as to lift and lower the stacking portion; and a lifting and lowering mechanism which lifts and lowers the stacking portion, wherein the stacking portion has a connecting portion which connects the stacking portion to the housing portion, the connecting portion can connect the stacking portion to the housing portion in a direction crossing the lifting and lowering direction of the stacking portion, and the lifting and lowering mechanism has a restricting portion which restricts rattling in a direction crossing the lifting and lowering direction of the stacking portion.

21. A sheet stacking apparatus comprising:

a stacking portion on which a discharged sheet is stacked;

a lifting and lowering mechanism which lifts and lowers the stacking portion and can support the stacking portion so as to lift and lower the stacking portion; and a housing portion which can support the lifting and lowering mechanism, wherein the stacking portion has a connecting portion which connects the stacking portion to the housing portion, the connecting portion can connect the stacking portion to the lifting and lowering mechanism in a direction crossing the lifting and lowering direction of the stacking portion, and the lifting and lowering mechanism has a restricting portion which restricts rattling in a direction crossing the lifting and lowering direction of the stacking portion.

22. A sheet processing apparatus comprising:

an intermediate stacking portion on which a sheet is stacked;

a sheet processing portion which processes the sheet stacked on the intermediate stacking portion; and a sheet stacking apparatus on which the processed sheet is stacked, the sheet stacking apparatus comprising:

a stacking portion on which a discharged sheet is stacked;

a lifting and lowering mechanism which lifts and lowers the stacking portion and can support the stacking portion so as to lift and lower the stacking portion; and a housing portion which can support the lifting and lowering mechanism, wherein the stacking portion has a connecting portion which connects the stacking portion to the housing portion, the connecting portion can connect the stacking portion to the lifting and lowering mechanism in a direction crossing the lifting and lowering direction of the stacking portion, and the lifting and lowering mechanism has a restricting portion which restricts rattling in a direction crossing the lifting and lowering direction of the stacking portion.

23. An image forming apparatus comprising:

an image forming portion which forms an image on a sheet; and a sheet processing apparatus which processes the sheet on which the image is formed, wherein the sheet processing apparatus comprises:

an intermediate stacking portion on which a sheet is stacked;

a sheet processing portion which processes the sheet stacked on the intermediate stacking portion; and a sheet stacking apparatus on which the processed sheet is stacked, wherein the sheet stacking apparatus comprises:

a stacking portion on which a discharged sheet is stacked;

a lifting and lowering mechanism which lifts and lowers the stacking portion and can support the stacking portion so as to lift and lower the stacking portion; and a housing portion which can support the lifting and lowering mechanism, wherein the stacking portion has a connecting portion which connects the stacking portion to the housing portion, the connecting portion can connect the stacking portion to the lifting and lowering mechanism in a direction crossing the lifting and lowering direction of the stacking portion, and the lifting and lowering mechanism has a restricting portion which restricts rattling in a direction crossing the lifting and lowering direction of the stacking portion.

24. An image forming apparatus comprising:

an image forming portion which forms an image on a sheet; and a sheet stacking apparatus on which the sheet with an image formed is stacked, wherein the sheet stacking apparatus comprises:

a stacking portion on which a discharged sheet is stacked;

a lifting and lowering mechanism which lifts and lowers the stacking portion and can support the stacking portion so as to lift and lower the stacking portion; and a housing portion which can support the lifting and lowering mechanism, wherein the stacking portion has a connecting portion which connects the stacking portion to the housing portion, the connecting portion can connect the stacking portion to the lifting and lowering mechanism in a direction crossing the lifting and lowering direction of the stacking portion, and the lifting and lowering mechanism has a restricting portion which restricts rattling in a direction crossing the lifting and lowering direction of the stacking portion.

* * * * *